United States Patent [19]

Shirai et al.

[11] Patent Number: 4,940,642

[45] Date of Patent: Jul. 10, 1990

[54] ELECTROPHOTOGRAPHIC LIGHT RECEIVING MEMBER HAVING POLYCRYSTALLINE SILICON CHARGE INJECTION INHIBITION LAYER PREPARED BY CHEMICAL REACTION OF EXCITED PRECURSORS AND A-SI:C:H SURFACE LAYER

[75] Inventors: Shigeru Shirai; Keishi Saito; Takayoshi Arai; Minoru Kato; Yasushi Fujioka, all of Shiga, Japan

[73] Assignee: Canon Kabushiki Kaisha, Tokyo, Japan

[21] Appl. No.: 302,114

[22] Filed: Jan. 26, 1989

Related U.S. Application Data

[63] Continuation-in-part of Ser. No. 21,342, Mar. 3, 1987, abandoned.

[30] Foreign Application Priority Data

Mar. 5, 1986 [JP] Japan ..... 61-48018

[51] Int. Cl.[5] ..... G03G 5/14; G03G 5/082

[52] U.S. Cl. ..... 430/65; 430/67

[58] Field of Search ..... 430/65, 67

[56] References Cited

U.S. PATENT DOCUMENTS

| | | | |
|---|---|---|---|
| 4,420,546 | 12/1983 | Kanbe et al. | 430/65 X |
| 4,510,224 | 4/1985 | Yamazaki et al. | 430/65 X |
| 4,582,773 | 4/1986 | Johncock et al. | 430/65 |
| 4,675,265 | 6/1987 | Kazama et al. | 430/67 |
| 4,678,731 | 7/1987 | Yoshizawa et al. | 430/65 |
| 4,683,185 | 7/1987 | Osawa et al. | 430/57 |
| 4,687,722 | 8/1987 | Ogawa et al. | 430/59 |

FOREIGN PATENT DOCUMENTS

| | | | |
|---|---|---|---|
| 0176936 | 4/1986 | European Pat. Off. | 430/65 |

*Primary Examiner*—Roland E. Martin

*Attorney, Agent, or Firm*—Fitzpatrick, Cella, Harper & Scinto

[57] ABSTRACT

There are provided on improved light receiving member for use in electrophotography and a process for the production thereof. The light receiving member comprises a substrate usable for electrophotography and a light receiving layer constituted by a charge injection inhibition layer formed of a polycrystalline material containing silicon atoms as the main constituent atoms and an element for controlling the conductivity, a photoconductive layer formed of an amorphous material containing silicon atoms as the main constituent atoms and at least one kind selected from hydrogen atoms and halogen atoms and a surface layer formed of an amorphous material containing silicon atoms, carbon atoms and hydrogen atoms, said polycrystalline material of which the charge injection inhibition layer being formed being a polycrystalline material prepared by introducing a precursor capable of contributing to formation of the charge injection inhibition layer and an active species reactive with the precursor separately into a film deposition space and chemically reacting them.

35 Claims, 15 Drawing Sheets

(A)

(B)

(C)

ELECTROPHOTOGRAPHIC LIGHT RECEIVING MEMBER HAVING POLYCRYSTALLINE SILICON CHARGE INJECTION INHIBITION LAYER PREPARED BY CHEMICAL REACTION OF EXCITED PRECURSORS AND A-SI:C:H SURFACE LAYER

This application is a STET of application Ser. No. 021,342 filed Mar. 3, 1987, now abandoned.

FIELD OF THE INVENTION

This invention relates to an improved light receiving member for use in electrophotography which is sensitive to electromagnetic waves such as light (which herein means in a broader sense those lights such as ultra-violet rays, visible rays, infrared rays, X-rays and γ-rays) and to a process for producing the same.

BACKGROUND OF THE INVENTION

For the photoconductive material to constitute a light receiving layer in a light receiving member for use in electrophotography, it is required to be highly sensitive, to have a high SN ratio [photocurrent (Ip)/dark current (Id)], to have absorption spectrum characteristics suited for the spectrum characteristics of an electromagnetic wave to be irradiated, to be quickly responsive and to have a desired dark resistance. It is also required to be not harmful to living things as well as man upon the use.

Especially, in the case where it is the light receiving member to be applied in an electrophotographic machine for use in office, causing no pollution is indeed important.

From these standpoints, the public attention has been focused on light receiving members comprising amorphous materials containing silicon atoms (hereinafter referred to as "A-Si"), for example, as disclosed in Offenlegungsschriftes Nos. 2746967 and 2855718 which disclose use of the light receiving member as an image-forming member in electrophotography.

For the conventional light receiving members comprising A-Si materials, there have been made improvements in their optical, electric and photoconductive characteristics such as dark resistance, photosensitivity, and photoresponsiveness, use-environmental characteristics, economic stability and durability.

However, there are still left subjects to make further improvements in their characteristics in the synthesis situation in order to make such light receiving member practically and effectively usable.

For example, in the case where such conventional light receiving member is employed in the light receiving member for use in electrophotography with aiming at heightening the photosensitivity and dark resistance, there are often observed a residual voltage on the conventional light receiving member upon the use, and when it is repeatedly used for a long period of time, fatigues due to the repeated use will be accumulated to cause the so-called ghost phenomena inviting residual images.

Further, in the preparation of the light receiving layer of the conventional light receiving member for use in electrophotography using an A-Si material, hydrogen atoms, halogen atoms such as fluorine atoms or chlorine atoms, elements for controlling the electrical conduction type such as boron atoms or phosphorus atoms, or other kinds of atoms for improving the characteristics are selectively incorporated in the light receiving layer.

However, the resulting light receiving layer sometimes becomes accompanied with defects on the electrical characteristics, photoconductive characteristics and/or breakdown voltage according to the way of the incorporation of said constituents to be employed.

That is, in the case of using the light receiving member having such light receiving layer, the life span of a photocarrier generated in the layer with the irradiation of light is not sufficient, the inhibition of a charge injection from the side of the substrate in a dark layer region is not sufficiently carried out, and image defects likely due to a local breakdown phenomenon which is so-called "white oval marks on half-tone copies" or other image defects likely due to abrasion upon using a blade for the cleaning which is so-called "white line" are apt to appear on the transferred images on a paper sheet.

Further, in the case where the above light receiving member is used in a much moist atmosphere, or in the case where after being placed in that atmosphere it is used, the so-called "image flow" sometimes appears on the transferred images on a paper sheet.

In consequence, it is necessitated not only to make a further improvement in an A-Si material itself but also to establish such a light receiving member not to invite any of the foregoing problems.

SUMMARY OF THE INVENTION

The object of this invention is to provide a light receiving member for use in electrophotography which has a light receiving layer free from the foregoing problems and capable of satisfying various kind of requirements in electrophotography.

That is, the main object of this invention is to provide a light receiving member for use in electrophotography which has a light receiving layer comprising a layer formed of A-Si and a layer formed of a polycrystalline material containing silicon atoms (hereinafter referred to as "poly-Si"), that electrical, optical and photoconductive properties are always substantially stable scarcely depending on the working circumstances, and that is excellent against optical fatigue, causes no degradation upon repeating use, excellent in durability and moisture-proofness and exhibits no or scarce residual voltage.

Another object of this invention is to provide a light receiving member for use in electrophotography which has a light receiving layer comprising a layer formed of A-Si and a layer formed of poly-Si, which is excellent in the close bondability with a substrate on which the layer is disposed or between the laminated layers, dense and stable in view of the structural arrangement and is of high quality.

A still another object of this invention is to provide a light receiving member for use in electrophotography which has a light receiving layer comprising a layer formed of A-Si and a layer formed of poly-Si, which exhibits a sufficient charge-maintaining function in the electrification process of forming electrostatic latent images and excellent electrophotographic characteristics when it is used in electrophotographic method.

A further object of this invention is to provide a light receiving member for use in electrophotography which has a light receiving layer comprising a layer formed of A-Si and a layer formed of poly-Si, which invites neither an image defect nor an image flow on the resulting visible images on a paper sheet upon repeated use in a long period of time and which gives highly resolved visible images with clearer half-tone which are highly dense and quality.

A still further object of this invention is to provide a light receiving member for use in electrophotography which has a light receiving layer comprising a layer formed of A-Si and a layer formed of poly-Si, which has a high photosensitivity, high S/N ratio and high electrical voltage withstanding property.

Other object of this invention is to provide a process for producing the foregoing light receiving members for use in electrophotography.

In order to overcome the foregoing problems on the conventional light receiving member for use in electrophotography and attaining the above-mentioned objects, the present inventors have made various studies while forcusing on its charge injection inhibition layer in the organic relationship with other constituent layers.

As a result, the present inventors have found that when the charge injection inhibition layer is formed of a poly-Si material which is obtained by reacting a particular presursor with a particular active species, the following advantages, among others, are brought about: the doping efficiency is remarkably improved so that the charge transportation degree may be enhanced and the polar dependency upon electrification process may be also enhanced; in view of the above, the thickness of the charge injection inhibition layer can be thinner than that in the conventional light receiving member for use in electrophotography; the contact of the charge injection inhibition layer with the substrate or the successively disposed constituent layer becomes ensured without the formed layer peeling off from the substrate and successively disposed constituent layer that will be a cause to invite defective images; and deterioration resistance of the light receiving layer is improved.

The present invention has been completed based on these findings.

Accordingly, this invention is to provide a light receiving member for use in electrophotography comprising a substrate for electrophotography and a light receiving layer comprising a charge injection inhibition layer formed of a polycrystalline material containing silicon atoms as the main constituent atoms and an element for controlling the conductivity (hereinafter referred to as "poly-Si:M", wherein M represents the element for controlling the conductivity), a photoconductive layer formed of an amorphous material containing silicon atoms as the main constituent atoms and at least one kind selected from hydrogen atoms and halogen atoms (hereinafter referred to as "A-Si(H,X)", wherein X represents halogen and a surface layer formed of an amorphous material containing silicon atoms, carbon atoms and hydrogen atoms (hereinafter referred to as "A-Si:C:H"), said polycrystalline material of which the charge injection inhibition layer being formed being a polycrystalline material prepared by introducing a precursor capable of contributing to formation of the charge injection inhibition layer and an active species reactive with the precursor separately into a film deposition space and chemically reacting them.

Further, this invention is provide a process for producing a light receiving member for use in electrophotography comprising a substrate for electrophotography and a light receiving layer comprising a charge injection inhibition layer formed of a poly-Si:M material, a photoconductive layer formed of an A-Si(H,X) material and a surface layer formed of an A-Si:C:H material, characterized in that the charge injection inhibition layer is prepared by introducing a precursor capable of contributing to formation of the charge injection inhibition layer and an active species reactive with the precursor separately into a film deposition space and chemically reacting them.

It is possible for the light receiving member according to this invention to have an absorption layer for light of long wavelength (hereinafter referred to as "IR layer"), which is formed of an amorphous material containing silicon atoms and germanium atoms, and if necessary, at least either hydrogen atoms or halogen atoms hereinafter referred to as "A-SiGe(H,X)", between the substrate and the charge injection inhibition layer.

It is also possible for the light receiving member according to this invention to have a contact layer, which is formed of an amorphous material containing silicon atoms as the main constituent atoms and at least one kind selected from nitrogen atoms, oxygen atoms and carbon atoms hereinafter referred to as "A-Si(N,O,C)"], between the substrate and the IR layer or between the substrate and the charge injection inhibition layer.

And the above-mentioned photoconductive layer may contain one or more kinds selected from oxygen atoms, nitrogen atoms, and an element for controlling the conductivity as the layer constituent atoms.

The above-mentioned charge injection inhibition layer may contain hydrogen atoms and/or halogen atoms, and, further, in case where necessary, at least one kind selected from nitrogen atoms, oxygen atoms and carbon atoms as the layer constituent atoms.

The above-mentioned IR layer may contain one or more kinds selected from nitrogen atoms, oxygen atoms, carbon atoms, and an element for controlling the conductivity as the layer constituent atoms.

The light receiving member having the above-mentioned light receiving layer for use in electrophotography according to this invention is free from the foregoing problems on the conventional light receiving members for use in electrophotography, has a wealth of practically applicable excellent electric, optical and photoconductive characteristics and is accompanied with an excellent durability and satisfactory use environmental characteristics.

Particularly, the light receiving member for use in electrophotography according to this invention has substantially stable electric characteristics without depending on the working circumstances, maintains a high photosensitivity and a high S/N ratio and does not invite any undesirable influence due to residual voltage even when it is repeatedly used for along period of time. In addition, it has sufficient moisture registant and optical fatigue resistance, and causes neither degradation upon repeating use nor any defect on breakdown voltage.

Because of this, according to the light receiving member for use in electrophotography of this invention, even upon repeated use for a long period of time, highly resolved visible images with clearer half tone which are highly dense and quality are stably obtained.

BRIEF DESCRIPTION OF THE DRAWINGS

FIG. 14(A) through FIG. 14 (C) are schematic views for examples of the shape at the surface of the substrate in the light receiving member for use in electrophotography according to this invention ;

DETAILED DESCRIPTION OF THE INVENTION

Figure 1A:
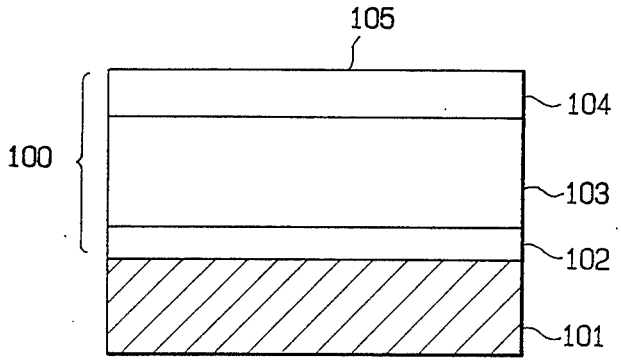
FIG. 1(A) through FIG. 1(D) are schematic views illustrating the typical layer constitution of a representative light receiving member for use in electrophotography according to this invention.

Representative embodiments of the light receiving member for use in electrophotography according to this invention will now be explained more specifically referring to the drawings. The description is not intended to limit the scope of this invention.

Representative light receiving members for use in electrophotography according to this invention are as shown in FIG. 1(A) through FIG. 1(D), in which are shown light receiving layer 100, substrate 101, charge injection inhibition layer 102, photoconductive layer 103, surface layer 104, free surface 105, IR layer 106, and contact layer 107.

FIG. 1(A) is a schematic view illustrating a typical representative layer constituion of this invention, in which is shown the light receiving member comprising the substrate 101 and the light receiving layer 100 constituted by the charge injection inhibition layer 102, the photoconductive layer 103 and the surface layer 104.

Figure 1B:
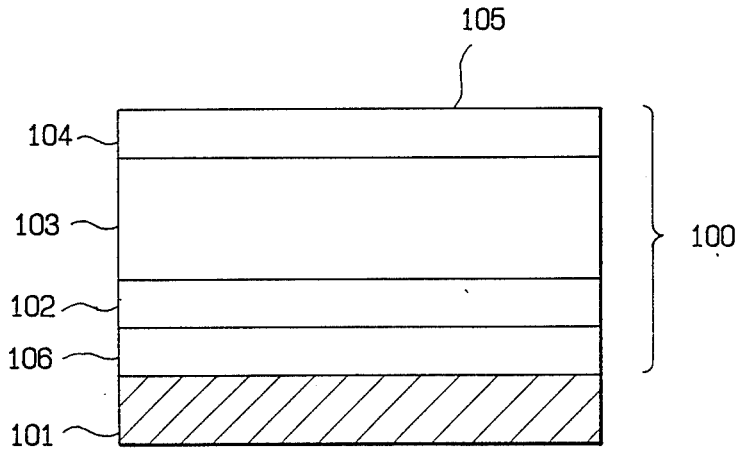

FIG. 1(B) is a schematic view illustrating another representative layer constitution of this invention, in which is shown the light receiving member comprising the substrate 101 and the light receiving layer 100 constituted by the IR layer 106, the charge injection inhibition layer 102, the photoconductive layer 103 and the surface layer 104.

Figure 1C:
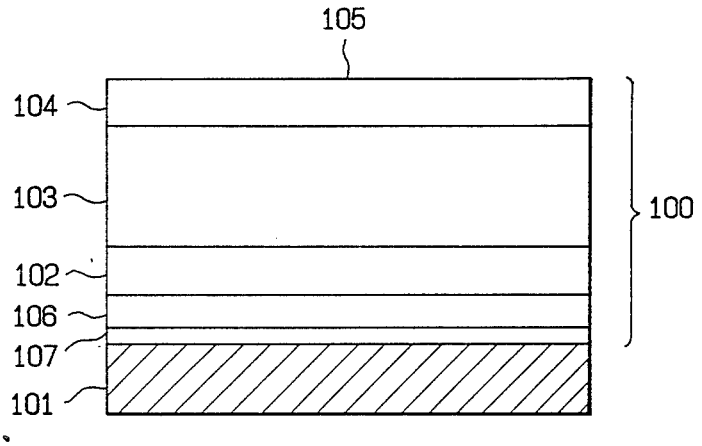

FIG. 1(C) is a schematic view illustrating another representative layer constitution of this invention, in which is shown the light receiving member comprising the substrate 101 and the light receiving layer 100 constituted by the contact layer 107, the IR layer 106, the charge injection inhibition layer 102, the photoconductive layer 103 and the surface layer 104.

Figure 1D:
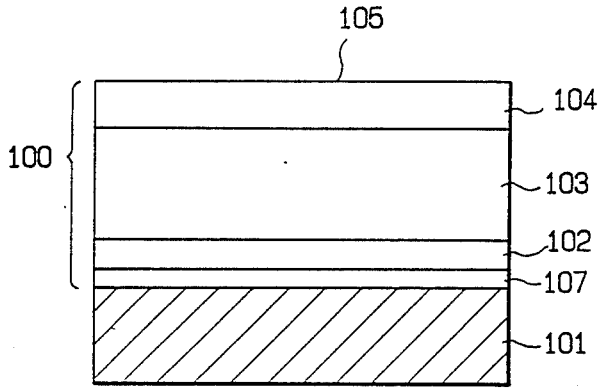

FIG. 1(D) is a schematic view illustrating another representative layer constitution of this invention, in which is shown the light receiving member comprising the substrate 101 and the light receiving layer 100 constituted by the contact layer 107, the charge injection inhibition layer 102, the photoconductive layer 103 and the surface layer 104.

Now, explanation will be made for the substrate and each constituent layer in the light receiving member of this invention.

Substrate 101

The substrate 101 for use in this invention may either be electroconductive or insulative. The electroconductive support can include, for example, metals such as NiCr, stainless steels, Al, Cr, Mo, Au, Nb, Ta, V, Ti, Pt and Pb or the alloys thereof.

The electrically insulative support can include, for example, films or sheets of synthetic resins such as polyester, polyethylene, polycarbonate, cellulose acetate, pllypropylene, polyvinyl chloride, polyvinylidene chloride, polystyrene, and polyamide, glass, ceramic and paper. It is preferred that the electrically insulative substrate is applied with electroconductive treatment to at least one of the surfaces thereof and disposed with a light receiving layer on the thus treated surface.

In the case of glass, for instance, electroconductivity is applied by disposing, at the surface thereof, a thin film made of NiCr, Al, Cr, Mo, Au, Ir, Nb, Ta, V, Ti, Pt, Pd, $In_2O_3$, $SnO_2$, ITO ($In_2O_3+SnO_2$), etc. In the case of the synthetic resin film such as a polyester film, the electroconductivity is provided to the surface by disposing a thin film of metal such as NiCr, Al, Ag, Pv, Zn, Ni, Au, Cr, Mo, Ir, Nb, Ta, V, Tl and Pt by means of vacuum deposition, electron beam vapor deposition, sputtering, etc., or applying lamination with the metal to the surface. The substrate may be of any configuration such as cylindrical, belt-like or plate-like shape, which can be properly determined depending on the application uses. For instance, in the case of using the light receiving member shown in FIG. 1 in continuous high speed reproduction, it is desirably configurated into an endless belt or cylindrical form.

The thickness of the support member is properly determined so that the light receiving member as desired can be formed.

In the case where flexibility is required for the light receiving member, it can be made as thin as possible within a range capable of sufficiently providing the function as the substrate. However, the thickness is usually greater than 10 μm is view of the fabrication and handling or mechanical strength of the substrate.

And, it is possible for the surface of the substrate to be uneven in order to eliminate occurrence of defective images caused by a so-called interference fringe pattern being apt to appear in the formed images in the case where the image formation is carried out using coherent monochromatic light such as laser beams.

In that case, the uneven surface shape of the substrate can be formed by the grinding work with means of an appropriate cutting tool, for example, having a V-form bite.

That is, said cutting tool is firstly fixed to the predetermined position of milling machine or lathe, then, for example, a cylindrical substrate is moved regularly in the predetermined direction while being rotated in accordance with the predetermined program to thereby obtain a surface-treated cylindrical substrate of a surface having irregularities in reverse V-form with a desirably pitch and depth.

The irregularities thus formed at the surface of the cylindrical substrate form a helical structure along the center axis of the cylindrical substrate The helical structure making the reverse V-form irregularities of the surface of the cylindrical substrate may be double or treble. Or otherwise, it may be of a cross-helical structure.

Further, the irregularities at the surface of the cylindrical substrate may be composed of said helical structure and a delay line formed along the center axis of the cylindrical substrate. The cross-sectional form of the convex of the irregularity formed at the substrate surface is in a reverse V-form in order to attain controlled unevenness of the layer thickness in the minute column for each layer to be formed and secure desired close bondability and electric contact between the substrate and the layer formed directly thereon.

Figure 14:
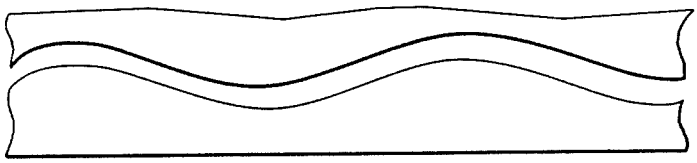
Figure 14:
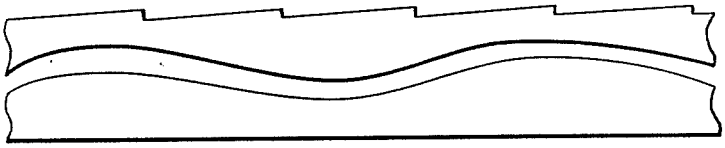
Figure 14:
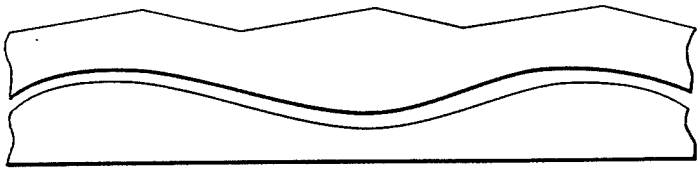

And as shown in FIG. 14, it is desirable for the reverse V-form to be an equilateral triangle, right-angled triangle or inequilateral triangle. Among these triangle forms, equilateral triangle form and right-angled triangle form are most preferred.

Each dimension of the irregularities to be formed at the substrate surface under the controlled conditions is properly determined having a due regard on the following points.

That is, firstly, a layer composed of A-Si(H,X) to constitute a light receiving layer is structurally sensitive to the surface state of the layer to be formed and the layer quality is apt to largely change in accordance with the surface state.

Therefore, it is necessary for the dimention of the irregularity to be formed at the substrate surface to be determined not to invite any decrease in the layer quality.

Secondly, should there exist extreme irregularities on the free surface of the light receiving layer, cleaning in the cleaning process after the formation of visible images becomes difficult to sufficiently carry out. In addition, in the case of carrying out the cleaning with a blade, the blade will be soon damaged.

From the viewpoints of avoiding the above problems in the layer formation and the electrophotographic processes, and from the conditions to prevent occurrence of the problems due to interference fringe patterns, the pitch of the irregularity to be formed at the substrate surface is preferably 0.3 to 500 μm, more preferably 1.0 to 200 μm, and, most preferably, 5.0 to 50 μm.

As for the maximum depth of the irregularity, it is preferably 0.1 to 5.0 μm, more preferably 0.3 to 3.0 μm, and, most preferably, 0.6 to 2.0 μm.

And when the pitch and the depth of the irregularity lie respectively in the above-mentioned range, the inclination of the slope of the dent (or the linear convex) of the irregularity is preferably 1° to 20°, more preferably 3° to 15°, and, most preferably, 4° to 10°

Further, as for the maximum figure of a thickness difference based on the ununiformity in the layer thickness of each layer to be formed on such substrate surface, in the meaning within the same pitch, it is preferably 0.1 to 2.0 μm, more preferably 0.1 to 1.5 μm, and, most preferably, 0.2 μm to 1.0 μm.

In alternative, the irregularity at the substrate surface may be composed of a plurality of fine spherical dimples which are more effective in eliminating the occurrence of defective images caused by the interferenice fringe patterns especially in the case of using coherent monochromatic light such as laser beams.

In that case, the scale of each of the irregularities composed of a plurality of fine spherical dimples is smaller than the resolving power required for the light receiving member for use in electrophotography.

Figure 16:
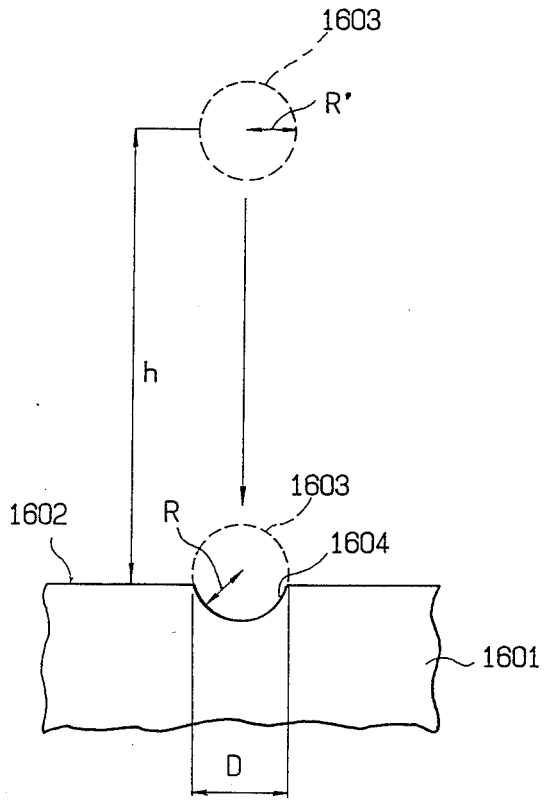
FIGS. 16 through 17 are schematic explanatory views of a preferred method for preparing the substrate having the preferred surface used in the light receiving member shown in FIG. 15.
Figure 17:
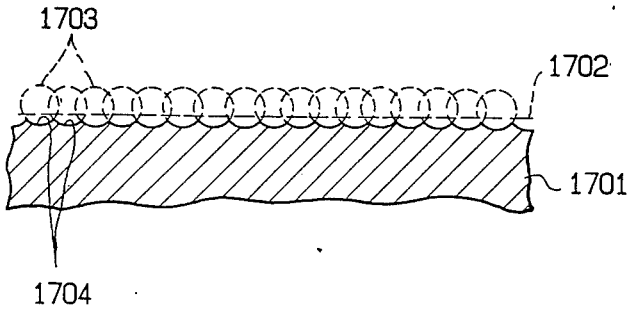

A typical method of forming the irregularities composed of a plurality of fine spherical dimples at the substrate surface will be hereunder explained referring to FIGS. 16 and 17.

FIG. 16 is a schematic view for a typical example of the shape at the surface of the substrate in the light receiving member for use in electrophotography according to this invention, in which a portion of the uneven shape is enlarged. In FIG. 16, are shown a support 1601, a support surface 1602, a rigid true sphere 1603, and a spherical dimple 1604.

FIG. 16 also shows an example of the preferred methods of preparing the surface shape as mentioned above. That is, the rigid true sphere 1603 is caused to fall gravitationally from a position at a predetermined height above the substrate surface 1602 and collide against the substrate surface 1602 to thereby form the spherical dimple 1604. A plurality of fine spherical dimples 1604 each substantially of an identical radius of curvature R and of an identical width D can be formed to the substrate surface 1602 by causing a plurality of rigid true spheres 1603 substantially of an identical diameter R' to fall from identical height h simultaneously or sequentially.

FIG. 17 shows a typical embodiment of a substrate formed with the uneven shape composed of a plurality of spherical dimples at the surface as described above.

In the embodiment shown in FIG. 17 , a plurality of dimples pits 1704, 1704 ... substantially of an identical radius of curvature and substantially of an identical width are formed while being closely overlapped with each other thereby forming an uneven shape regularly by causing to fall a plurality of spheres 1703, 1703, ... regularly and substantially from an identical height to different positions at the surface 1702 of the support 1701. In this case, it is naturally required for forming the dimples 1704, 1704 ... overlapped with each other that the spheres 1703, 1703 ... are gravitationally dropped such that the times of collision of the respective spheres 1703 to the support 1702 and displaced from each other.

By the way, the radius of curvature R and the width D of the uneven shape formed by the spherical dimples at the substrate surface of the light receiving member fur use in electrophotography according to this invention constitute an important factor for effectively attaining the advantageous effect of preventing occurrence of the interference fringe in the light receiving member for use in electrophotography according to this invention. The present inventors carried out various experiments and, as a result, found the following facts.

That is, if the radius of curvature R and the width D satisfy the following equation:

$$\frac{D}{R} \geqq 0.035$$

0.5 or more Newton rings due to the sharing interference are present in each of the dimples. Further, if they satisfy the following equation:

$$\frac{D}{R} \geqq 0.055$$

one or more Newton rings due to the sharing interference are present in each of the dimples.

From the foregoing, it is preferred that the ratio D/R is greater than 0.035 and, preferably, greater than 0.055 for dispersing the interference fringes resulted throughout the light receiving member in each of the dimples thereby preventing occurrence of the interference fringe in the light receiving member.

Further, it is desired that the width D of the unevenness formed by the scraped dimple is about 500 μm at the maximum, preferably, less than 200 μm and, more preferably less than 100 μm.

Figure 15:
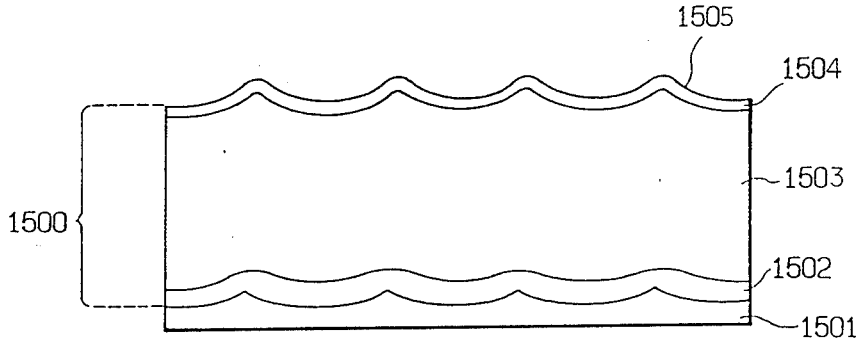
FIG. 15 is a schematic view for a preferred example of the light receiving member for use in electrophotography according to this invention which has a light receiving layer as shown in FIG. 1 (A) formed on the substrate having a preferred surface.

FIG. 15 is an enlarged portion view of a preferred example of the light receiving member for use in electrophotography according to this invention in which a light receiving layer 1500 constituted by a charge injection inhibition layer 1502 which is formed of a poly-Si:M material, a photoconductive layer 1503 which is formed of an A-Si(H,X) and a surface layer 1504 having a free surface 1505 which is formed of an A-Si:C:H material is disposed on a substrate 1501 having the unevenly shaped surface prepared in accordance with the above-mentioned method along the slopes of the irregularities composed of spherical dimples of the substrate. For this light receiving member for use in electrophotography, since the radius of curvature of the spherical dimples formed at the interface in the light receiving layer 1500 is not identical with that formed at the free surface 1505, the reflection light at the interface and the reflection light at the free surface have reflection angles different from each other. Because of this, a sharing interference corresponding to the so-called Newton ring phenomenon occurs and the interference fringe is dispersed within the dimples. Then, if the interference ring should appear in the microscopic point of view in the images caused by way of the light receiving member, it is not visually recognized.

That is, in the light receiving member having the light receiving layer of multi-layered structure 1500 formed on the substrate having such a surface 1501, lights passing through the light receiving layer 1500 reflect on the layer interface and at the substrate surface and interfer each other to thereby effectively prevent the resulting images from being accompanied with infringe patterns.

Charge Injection Inhibition Layer 102 (or 1502) and Preparation thereof In the light receiving member for use in electrophotography of this invention, the charge injection inhibition layer is formed typically of a poly-Si:M material. However, it is possible for the charge injection inhibition layer to contain hydrogen atoms (H) or/and halogen atoms (X), and if necessary, at least one kind selected from nitrogen atoms, oxygen atoms and carbon atoms in the state of being distributed uniformly in the entire layer region or partial layer region but largely in the side of the substrate.

The charge injection inhibition layer can be disposed not only on the substrate but also on the IR layer or the contact layer.

Now, as for the element (M) for controlling the conductivity to be contained, so-called impurities in the field of the semiconductor can be mentioned and those usable herein can include atoms belonging to the group III of the Periodic Table that provide p-type conductivity (hereinafter simply referred to as "group III atoms") or atoms belonging to the group V of the Periodic Table that provide n-type conductivity (hereinafter simply referred to as "group V atoms").

In the case where the charge injection inhibition layer is such that contains hydrogen atoms or/and halogen atom may be F (fluorine), Cl (chlorine), Br (bromine) or I (iodine), F and Cl being particularly desirable.

The amount of hydrogen atoms (H), the amount of the halogen atoms (X) or the sum of the amounts for the hydrogen atoms and the halogen atoms (H+X) contained in the charge injection inhibition layer is preferably 1 to 40 atomic %, and, most preferably, 5 to 30 atomic %.

In the case where the charge injection inhibition layer is such that contains at least one kind selected from nitrogen atoms, oxygen atoms and carbon atoms, the amount of at least one kind selected from nitrogen atoms, oxygen atoms and carbon atoms is properly determined according to desired requirements. However, it is preferably $1\times10^{-3}$ to 50 atomic %, more preferably, $2\times10^{-3}$ atomic % to 40 atomic %, and, most preferably, $3\times10^{-3}$ to 30 atomic %.

For the thickness of the charge injection inhibition layer, it is preferably $1\times10^{-2}$ to 10 μm, more preferably, $5\times10^{-2}$ to 8 μm, and, most preferably, $1\times10^{-1}$ to 5 μm in the viewpoints of bringing about electrophotographic characteristics and economical effects.

The charge injection inhibition layer of the light receiving member for use in electrophotography according to this invention is prepared by using a precursor contributing to formation of said layer and an active species which is chemically reactive with the precursor even at lower temperature and chemically reacting the two kinds of materials without the presence of a plasma to form said layer on an appropriate substrate located in a film deposition space of a closed system at a high deposition rate.

In this respect, there are the advantages accruing from the formation of the charge injection inhibition layer of the light receiving member for use in electrophotography without elevating the temperature of the substrate and in the absence of plasma, this being distinguished from the case of the known plasma CVD method. For example, a desirable charge injection inhibition layer having an uniform thickness and a desirable homogeneity may be effectively formed at an improved deposition rate without the formed layer peeling off from the substrate, which often found in the known plasma CVD method when it is practices with the substrate being maintained at lower temperature, and the layer which is formed on the substrate is not affected either by any of the undesirable materials removed from the inner surface of the surrounding wall of the deposition space or by the residual gases remaining in the deposition space, because the deposition space, the active species generation space, and the precursor generation space are individually situated.

Now, the term "precursor" in this invention means a substance which can be a constituent of the charge injection inhibition layer but cannot or scarcely contribute to layer formation as long as it is in its "ground level" energy state.

On the other hand, the term "active species" in this invention means a substance which causes a chemical reaction with the precursor to impart energy to the precursor thereby to cause the precursor to be in an activated energy state capable of contributing to formation of the charge injection inhibition layer.

Therefore, as for the active species to be used, it may be either a substance which contains one or more elements capable of being constituents of the charge injection inhibition layer to be formed or a substance which does not contain such elements.

The precursor which is introduced into the film deposition space will become a principal constituent of the charge injection inhibition layer to be formed on the substrate as a result of the chemical reaction with the active species in the film deposition space.

The longer the average life span of the precursor the better. A substance whose average life span is preferably greater than 0.1 second, more preferably greater that 1.0 second and most preferably greater than 5.0 seconds is used.

The active species to be introduced into the film deposition space should be a substance whose average life span is preferably less than 10 seconds, more preferably less than 8.0 seconds, and most preferably less than 5.0 seconds.

At the time when the charge injection inhibition layer is formed on the substrate in the film deposition space, the active species chemically reacts with the precursor containing one or more elements to be principal constituent(s) of the layer to be formed. The precursor being introduced into the film deposition space at the same time when the active species is introduced thereinto, and they are chemically reacted while being subjected to the action of heat energy supplied from the substrate, whereby the desired film to be the charge injection inhibition layer is easily and effectively formed on the substrate.

According to this invention, because the charge injection inhibition layer may be formed without any generation of a plasma in the film deposition space, there is no occasion for the layer to be subjected to the influence of an etching action or other actions due to unexpectedly occurring abnormal discharge and the like during its formation, as found in the known plasma CVD method.

One remarkable point among others by which the method of this invention for forming the charge injection inhibition layer is clearly distinguished from the known CVD method is that there are used an active species and a precursor which are generated in respective spaces separately situated from the deposition space.

Because of this, this invention brings about various significant advantages such that in comparison with the known plasma CVD method, the deposition rate is greatly improved and at the same time, a charge injection inhibition layer composed of a polycrystalline material which is superior in quality and which has very stable characteristics may be obtained. In addition, the temperature of the substrate during the film formation process can be lower, and a charge injection inhibition layer composed of a polycrystalline material possessing an excellent film quality may be mass-produced on an industrial scale thereby enabling low cost production.

The precursor and the active species to be used in this invention may be properly generated by activating a selected raw material gas in the respective generation space, for example, by subjecting it to the action of an excitation energy source such as electric energy e.g. electric discharge of microwave, RF (radio frequency), low frequency or DC (direct current), heat of electric heater or infrared heater, or light, or by reacting or contacting it with a catalyst or adding the catalyst.

For instance, the precursor to be employed for the formation of the charge injection inhibition layer in this invention may be generated by activating a precursor generating raw material gas in the precursor generation space, for example, by subjecting it to the action of an electric energy source, heat or light.

As the precursor generating raw material, there can be mentioned a silicon and halogen containing compound.

As such silicon and halogen containing compound, there can be mentioned such that part or the entire of the hydrogen atoms of chain or cyclic silicon hydrides are substituted by halogen atoms, for example, chain silicon halides represented by the general formula: Siu Y2u+2 wherein u is an integer of 1 or more, and Y is a member selected from the group consisting of F, Cl, Br and I, cyclic silicon halides represented by the general formula: Siv Y2v wherein v is an integer of 3 or more and Y has the same meaning as above mentioned, and chain or cyclic compounds represented by the general formula: $SiuHxY_y$ wherein u and Y have the same meanings as above mentioned, and $x+y=2u$ or $x+y=2u+2$.

Specific examples are $SiF_4$, $(SiF_2)_5$, $(SiF_2)_6$, $(SiF_2)_4$, $Si_2F_6$, $Si_3F_8$, $Si_4F_{10}$, $SiHF_3$, $SiH_2F_2$, $SiH_3F$, $SiCl_4$, $(SiCl_2)_5$, $SiBr_4$, $(SiBr_2)_5$, $Si_2Cl_6$, $Si_3Cl_8$, $Si_2Br_6$, $Si_3Br_8$, $SiHCl_3$, $SiH_2Cl_2$, $SiHBr_3$, $SiH_2Br_2$, $SiHI_3$, $SiH_2I_2$, $Si_2H_3F_3$, $Si_2Cl_3F_3$, etc. which are in the gaseous state or can be easily made to be in the gaseous state.

And it is possible to use one of these compounds or a mixture of two or more of these compounds.

In the case of generating the precursor using the above mentioned compound, it is possible to use a silicon containing compound other than the foregoing compounds such as silicon monomer material, hydrogen gas or halogen gas such as $F_2$ gas, $Cl_2$ gas, gasified $Br_2$ or $I_2$ together with the foregoing compound. And other than these, a rare gas such as He, Ne, Ar, etc. is also usable.

Other than those compounds as above mentioned, it is possible for the raw material gas to be used for the generation of the precursor to be such that is below mentioned.

As such raw material gas for the generation of the precursor, there can be mentioned a raw material gas containing silicon atom and halogen atom which is obtained by blowing a halogen gas such as $F_2$ gas, $Cl_2$ gas, gasified $Br_2$ or $I_2$ into silicon solid particles being kept at elevated temperature.

The active species to be used for the formation of the charge injection inhibition layer may be properly generated by activating a selected active species generating raw material gas, for example, by subjecting it to the action of an appropriate excitation energy source selected from those above mentioned in the active species generation space.

Usable such an active species generating raw material are, for example, hydrogen gas ($H_2$) and a hydrogen containing gas such as a hydrogen halogenide e.g. HF gas, HCl gas, HCl gas, gasified HBr and gasified HI.

And other than these gases, rare gases such as He, Ne, Ar, etc. are also usable

In the case of using plural kinds of these gases it is possible to introduce those gases individually or a mixture of two or more of those gases into the active species generation space.

In an alternative for the generation of the active species in this invention using plural kinds of raw materials, it is possible to generate plural kinds of the active species in respective active species generation spaces and introduce them separately into the film deposition space.

The volume ratio of the precursor to the active species to be introduced into the film deposition space should be determined with due regard to the film forming conditions, the kind of the precursor to be used and the kind of the active species to be used etc., but it is preferably 20:1 to 1:20, and more preferably 10:1 to 1:10 on the basis of a flow amount ratio.

For the charge injection inhibition layer of the light receiving member for use in electrophotography, it is possible to be doped with the so-called impurity in the field of semiconductor i.e. a p-type impurity or an n-type impurity during its formation process or after terminating the process.

As the p-type impurity, there may be used an element of Group IIIA of the Periodic Table such as B, Al, Ga, In, Tl or the like. Of these p-type impurities, B and Ga are the most appropriate. As the n-type impurity, there may be used an element of Group VA of the Periodic Table such as P, As, Sb, Bi or the like. Of these n-type impurities, P and Sb are the most appropriate.

The amount of the p-type impurity or the n-type impurity to be contained in the resulting film may be optionally determined in accordance with its electric and optical characteristics as required therefor.

As a dopant imparting a substance capable of incorporating the impurity into the film, a substance which is in a gaseous state at room temperature under atmospheric pressure condition or another substance which can be easily made to be in a gaseous state, at least under the activating conditions for either the precursor or the active species.

Usable as such substance are, for example, $PH_3$, $P_2H_4$, $PF_3$, $PF_5$, $PCl_3$, $AsH_3$, $AsF_3$, $AsF_5$, $AsCl_3$, $SbH_3$, $SbF_5$, $BF_3$, $BCl_3$, $BBr_3$, $B_2H_6$, $B_4H_{10}$, $B_5H_9$, $B_5H_{11}$, $B_6H_{10}$, $B_6H_{12}$, $AlCl_3$, etc.

It is possible to use one or more of these substances.

In order to activate the dopant imparting substance, it can be introduced together with the raw material for the precursor or/and the raw material for the active species into the precursor generation space or/and the active species generation space.

In an alternative, it is possible to introduce the dopant imparting substance into a special activation space for activating it with the action of an excitation energy source in the same way sa above mentioned and to introduce the resulting precursor of imparting a dopant (that is, the precursor $PN_4$) into the film deposition space.

Further, it is possible for the charge injection inhibition layer of the light receiving member for use in electrophotography according to this invention to contain at least one kind atom selected from oxygen atom, nitrogen atom and carbon atom. For the incorporation of such atom into the charge injection inhibition layer, it is desirable that a gas containing a source of such atom is activated to generate a precursor, and the resulting precursor is introduced into the film deposition space to thereby incorporate such atom into that layer.

For instance, an appropriate gas containing an oxygen source, a nitrogen source or a carbon source is introduced together with the precursor generating raw material gas on the active species generating raw material gas into the precursor generation space or the active species generation space to thereby activate it to be a relevant precursor together with the other raw material being activated to be the precursor or the active species. In an alternative, it is possible to introduce such gas into a special activation space for activating it with the action of an appropriate excitation energy source.

As the raw material imparting an oxygen atom, nitrogen atom or carbon atom, a substance which is in a gaseous state at room temperature under atmospheric pressure condition or another substance which can be easily made to be in a gaseous state, at least under the activating conditions for either the precursor or the active species.

As the nitrogen source containing raw material, there can be mentioned a nitrogen monomeric substance ($N_2$) and substances containing a nitrogen atom and one or more different kind atoms such as hydrogen atom (H), halogen atom (X)[X=F, Cl, Br or I], sulfur atom (S), carbon atom (C), oxygen atom (0), silicon atom (Si) or germanium atom (Ge).

Other than these substances, substances containing a nitrogen atom and one or more kind atoms other than those mentioned above are also usable as long as they meet the requirements.

Usable as the substance containing N and H are, for example, $HN_3$, $NH_4N_3$, $NH_5$, $H_2NNH_2$ and primary to tertiary amines. Said amines can be halogenated amines or hydroxyl amines. As the substance containing N and X, there can be mentioned $NX_3$, $N_3X_1$, $N_2X_2$, NOX, $NO_2X$ and $NO_3X_4$.

As the substance containing N and S, there can be mentioned $N_4S_4$ and $N_2S_5$. As the substance containing N and C, there can be mentioned $N(CH_3)_3$, HCN, cyanogens, HOCN and HSCN.

As the substance containing N and 0, there can be mentioned $N_2O$, NO, $NO_2$, $N_2O_3$, $N_2O_4$, $N_2O_5$ and $NO_3$.

Other than these compounds, there can be also mentioned silazanes and organosilicon compounds having a Si-N bond such as organosilazanes, organosilicon isocyanates and organosilicon isothiocyanates.

Specific examples for the silazane are disilazane and trisilazane. Specific examples for organosilazane are $(C_2H_5)_3SiNH_2$, $[(CH_3)_3Si]_2NH$ and $[(C_2H_5)_3Si]_2NH$.

Specific examples for the organosilicon isocyanate are $(CH_3)_3SiNCO$ and $(CH_3)_2Si(NCO)_2$. A specific example for the organosilicon isothiocyanate is $(CH_3)_3SiNCS$.

It is possible to use one or more of these compounds.

As the oxygen source containing raw material, there can be mentioned an oxygen monomeric substance such as $O_2$ and $O_3$ and substances containing an oxygen atom and one or more different kind atoms such as hydrogen atom (H), halogen atom (X)[X=F, Cl, Br or I], sulfur atom (S), carbon atom (C), silicon atom (Si) and germanium atom (Ge).

Other than these substances, substances containing a oxygen atom and one or more kind atoms other than those mentioned above are also usable as long as they meet the requirements.

Specific examples for the substance containing O and S are $H_2O$ and $H_2O_2$. Specific examples for the substance containing O and S are $SO_2$ and $SO_3$. Specific examples for the substance containing O and C are CO, $CO_2$ and $H_2CO_3$. Specific examples for the substance containing O and Si are $H_3SiOSiH_3$, $H_3SiOSiH_2OSiH_3$, $(CH_3)_2Si(OCOCH_3)_2$, $CH_3Si(OCOCH_3)_3$, $(CH_3)_3SiOCH_3$, $(CH_3)_2Si(OCH_3)_2$, $CH_3Si(OCH_3)_3$, $(CH_3)_3SiOH$, $(CH_3)_2(C_6H_5)SiOH$ and $(C_2H_5)_2Si(OH)_2$. Specific examples for the substance containing O and Ge are germanium oxides, germanium hydroxides, germanium acids, and organogermanium compounds such as $H_3GeOGeH_3$ and $H_3GeOGeH_2O$-$GeH_3$. It is possible to use one or more of these oxygen source containing substances.

As the carbon source containing raw material any of the foregoing substances can be optionally used as long as it contains a carbon source.

Now, the charge injection inhibition layer formed of a poly-SiM of the light receiving member for use in electrophotography according to this invention contains the element for controlling the conductivity represented by M in the state of being evenly distributed in the entire layer region, and preferably in the uneven state of being largely distributed in the layer region adjacent to the substrate.

As above mentioned, the charge injection inhibition layer may contain at least one kind atom selected from nitrogen atom, oxygen atom and carbon atom in the state of being evenly distributed in the entire layer region, and preferably in the uneven state of being largely distributed in the layer region adjacent to the substrate.

In that case, not only the close bondability of the charge injection inhibition layer with the substrate is improved but also the coordination of band gap is enhanced.

Explanation will be made to the typical embodiments for distributing the group III atoms or group V atoms in the direction toward the layer thickness in the charge injection inhibition layer while referring to FIGS. 2 through 6.

In FIGS. 2 through 6, the abscissa represents the distribution concentration C of the group III atoms or group V atoms and the ordinate represents the thickness of the charge injection inhibition layer; and $t_B$ represents the extreme position of the layer adjacent to the substrate and $t_T$ represents the other extreme position of the layer which is away from the substrate.

The charge injection inhibition layer is formed from the $t_B$ side toward the $t_T$ side.

Figure 2:
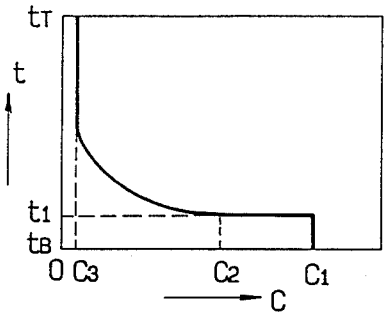
FIG. 2 through FIG. 6 are views illustrating the thicknesswise distribution of the group III atoms or the group V atoms in the charge injection inhibition layer.

FIG. 2 shows the first typical example of the thicknesswise distribution of the group III atoms or group V atoms in the charge injection inhibition layer. In this example, the group III atoms or group V atoms are distributed such that the concentration C remains constant at a value $C_1$ in the range from position $t_B$ to position $t_1$, and the concentration C gradually and continuously decreases from $C_2$ in the range from position $t_1$ to position $t_T$, where the concentration of the group III atoms or group V atoms is $C_3$.

Figure 3:
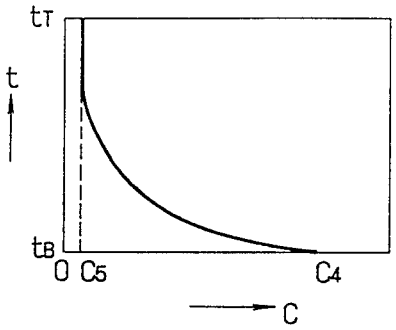

In the example shown in FIG. 3, the distribution concentration C of the group III atoms or group V atoms contained in the light receiving layer is such that concentration $C_4$ at position $t_B$ continuously decreases to concentration $C_5$ at position $t_T$.

Figure 4:
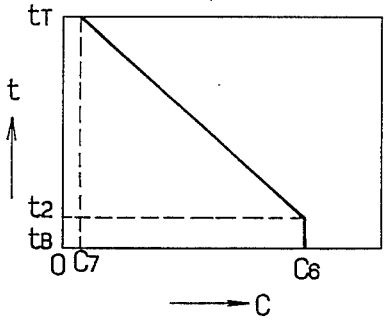

In the example shown in FIG. 4, the distribution concentration C of the group III atoms or group V atoms is such that concentration $C_6$ remains constant in the range from position $t_B$ to position $t_2$, *and concentration* $C_6$ linearly decreases to concentration $C_7$ in the range from position $t_2$ to position $t_T$.

Figure 5:
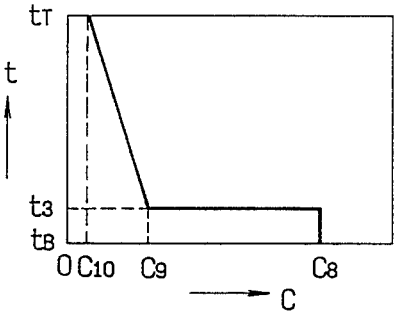

In the example shown in FIG. 5, the distribution concentration C of the group III atoms or group V atoms is such that concentration $C_8$ remains constant in the range from position $t_B$ and position $t_3$ and it linearly decreases from $C_9$ to $C_{10}$ in the range from position $t_3$ to position $t_T$.

Figure 6:
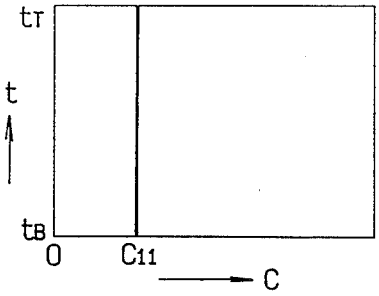

In the example shown in FIG. 6, the distribution concentration C of the group III atoms or group V atoms is such that concentration $C_{11}$ remains constant in the range from position $t_b$ and position $t_T$.

In the case where the group III atoms or group V atoms are contained in the charge injection inhibition layer in such way that the distribution concentration of the atoms in the direction of the layer thickness is higher in the layer region near the substrate, the thicknesswise distribution of the group III atoms or group V atoms is preferred to be made in the way that the maximum concentration of the group III atoms or group V atoms is controlled to be preferably greater than 50 atomic ppm, more preferably greater than 80 atomic ppm, and, most preferably, greater than $10^2$ atomic ppm.

For the amount of the group III atoms or group V atoms to be contained in the charge injection inhibition layer, it is properly determined according to desired requirements. However, it is preferably $3\times10$ to $5\times104$ atomic ppm, more preferably $5\times10$ to $1\times104$ atomic ppm, and, most preferably, $1\times10^2$ to $5\times10^3$ atomic ppm.

When at least one kind selected from nitrogen atoms, oxygen atoms and carbon atoms is incorporated in the charge injection inhibition layer, not only the mutual contact between the substrate and the charge injection inhibition layer and the bondability between the charge injection inhibition layer and the photoconductive layer but also the adjustment of band gap for that layer are effectively improved.

Explanation will be made to the typical embodiments for distributing at least one kind selected from nitrogen atoms, oxygen atoms and carbon atoms in the direction toward the layer thickness in the charge injection inhibiton layer, with reference to FIGS. 7 through 13.

In FIGS. 7 through 13, the abscissa represents the distribution concentration C of at least one kind selected from nitrogen atoms, oxygen atoms and carbon atoms, and the ordinate represents the thickness of the charge injection inhibition layer; and $t_B$ represents the extreme position of the layer adjacent to the substrate and $t_T$ represents the other extreme position of the layer which is away from the substrate. The charge injection inhibition layer is formed from the $t_B$ side toward the $t_T$ side.

Figure 7:
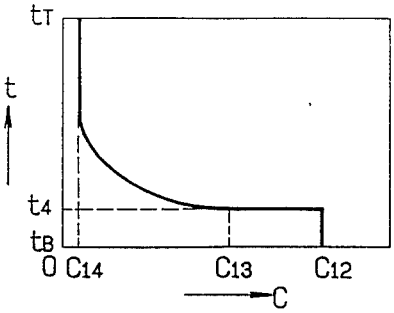
FIG. 7 through FIG. 13 are views illustrating the thicknesswise distribution of at least one kind selected from nitrogen atoms, oxygen atoms, and carbon atoms in the charge injection inhibition layer.

FIG. 7 shows the first typical example of the thicknesswise distribution of at least one kind selected from nitrogen atoms, oxygen atoms and carbon atoms in the charge injection inhibition layer. In this example, at least one kind selected from nitrogen atoms, oxygen atoms and carbon atoms are distributed such that the concentration C remains constant at a value $C_{12}$ in the range from position $t_B$ to position $t_4$, and the concentration C gradually and continuously decreases from $C_{13}$ in the range from position $t_4$ to position $t_T$, where the concentration of at least one kind selected from nitrogen atoms, oxygen atoms, and carbon atoms is $C_{14}$.

Figure 8:
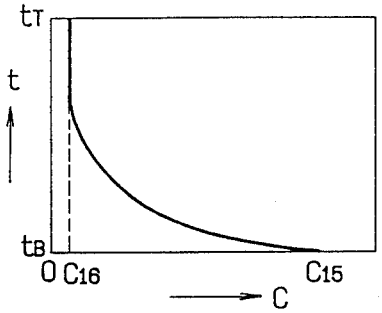

In the example shown in FIG. 8, the distribution concentration C of at least one kind selected from nitrogen atoms, oxygen atoms, and carbon atoms contained in the charge injection inhibition layer is such that concentration $C_{15}$ at position $t_B$ continuously decreases to concentration $C_{16}$ at position $t_T$.

Figure 9:
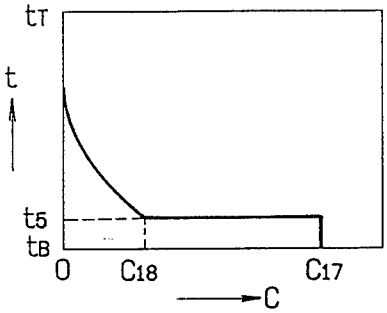

In the example shown in FIG. 9, the distribution concentration C of at least one kind selected from nitrogen atoms, oxygen atoms, and carbon atoms is such that concentration $C_{17}$ remains constant in the range from position $t_B$ and position $t_5$ and it gradually and continuously decreases from position $t_5$ and becomes substantially zero between $t_5$ and $t_T$.

Figure 10:
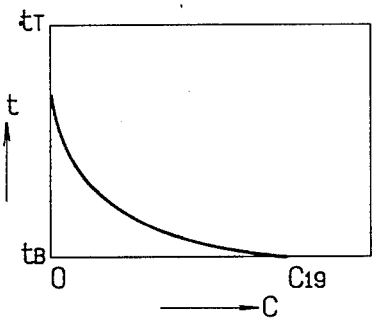

In the example shown in FIG. 10, the distribution concentration C of at least one kind selected from nitrogen atoms, oxygen atoms and carbon atoms is such that concentration $C_{19}$ gradually and continuously decreases from position $t_B$ and becomes substantially zero between $t_B$ and $t_T$.

Figure 11:
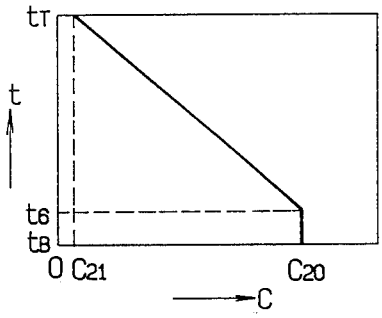

In the example shown in FIG. 11, the distribution concentration C of at least one kind selected from nitrogen atoms, oxygen atoms and carbon atoms is such that concentration $C_{20}$ remains constant in the range from position $t_B$ to position $t_6$, and concentration $C_{20}$ linearly decreases to concentration $C_{21}$ in the range from position $t_6$ to position $t_T$.

Figure 12:
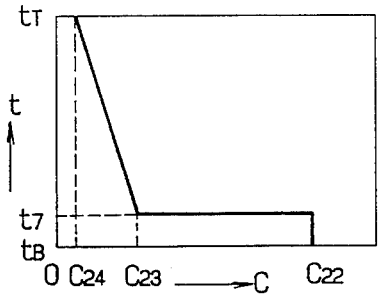

In the example shown in FIG. 12, the distribution concentration C of at least one kind selected from nitrogen atoms, oxygen atoms and carbon atoms is such that concentration $C_{22}$ remains constant in the range from position $t_B$ and position $t_7$ and it linearly decreases from $C_{23}$ to $C_{24}$ in the range from position $t_7$ to position $t_T$.

Figure 13:
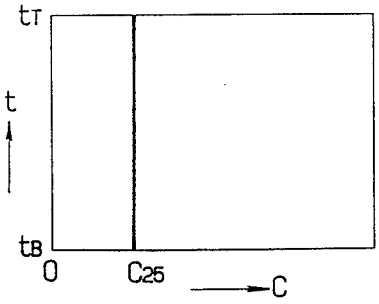

In the example shown in FIG. 13, the distribution concentration C of at least one kind selected from nitrogen atoms, oxygen atoms and carbon atoms is such that concentration $C_{25}$ remains constant in the range from position $t_B$ and position $t_T$.

In the case where at least one kind selected from nitrogen atoms, oxygen atoms and carbon atoms is contained in the charge injection inhibition layer such that the distribution concentration of these atoms in the layer is higher in the layer region near the substrate, the thicknesswise distribution of at least one kind selected from nitrogen atoms, oxygen atoms and carbon atoms is made in such way that the maximum concentration of at least one kind selected from nitrogen atoms, oxygen atoms and carbon atoms is controlled to be preferably greater than $5\times10^2$ atomic ppm, more preferably, greater than $8\times10^2$ atomic ppm, and, most preferably, greater than $1\times10^3$ atomic ppm.

Photoconductive Layer 103 (or 1502-2)

The photoconductive layer 103 (or 1502-2) is disposed on the charge injection inhibition layer 102 (or 1502-1) as shown in FIG. 1 (or FIG. 15).

The photoconductive layer is formed of an A-Si(H,X) material or an A-Si(H,X)(O,N) material.

The photoconductive layer has the semiconductor characteristics as under mentioned and shows a photoconductivity against irradiated light.

(i) p-type semiconductor characteristics : containing an acceptor only or both the acceptor and a donor in which the relative content of the acceptor is higher;

(ii) p-type semiconductor characteristics : the content of the acceptor (Na) is lower or the relative content of the acceptor is lower in the case (i);

(iii)n-type semiconductor characteristics : containing a donor only or both the donor and an acceptor in which the relative content of the donor is higher;

(iv) n-type semiconductor characteristics : the content of donor (Nd) is lower or the relative content of the acceptor is lower in the case (iii); and (v) i-type semiconductor characteristics : $Na\simeq Nd\simeq 0$ or $Na\simeq Nd$.

In order for the photoconductive layer to be a desirable type selected from the above-mentioned types (i) to (v), it can be carried out by doping a p-type impurity, an n-type impurity or both the impurity with the photoconductive layer to be formed during its forming process while controlling the amount of such impurity.

As the element to be such impurity to be contained in the photoconductive layer, the so-called impurities in the field of the semiconductor can be mentioned, and those usable herein can include atoms belonging to the group III or the periodical table that provide p-type conductivity (hereinafter simply referred to as "group III atom") or atoms belonging to the group V of the periodical table that provide n-type conductivity (hereinafter simply referred to as "group V atom"). Specifically, the group III atoms can include B (boron), Al (aluminum), Ga (gallium), In (indium) and Tl (thallium). The group V atoms can include, for example, P (phosphor), As (arsenic), Sb (antimony) and Bi (bismuth). Among these elements, B, Ga, P and As are particularly preferred.

The amount of the group III atoms or the group V atoms to be contained in the photoconductive layer is preferably $1\times10^{-3}$ to $3\times10^2$ atomic ppm, more preferably, $5\times10^{-3}$ to $1\times10^2$ atomic ppm, and, most preferably, $1\times10^{-2}$ to 50 atomic ppm.

In the photoconductive layer, oxygen atoms or/and nitrogen atoms can be incorporated in the range as long as the characteristics required for that layer is not hindered.

In the case of incorporating oxygen atoms or/and nitrogen atoms in the entire layer region of the photoconductive layer, its dark resistance and close bondability with the substrate are improved.

The amount of oxygen atoms or/and nitrogen atoms to be incorporated in the photoconductive layer is desired to be relatively small not to deteriorate its photoconductivity.

In the case of incorporating nitrogen atoms in the photoconductive layer, its photosensitivity in addition to the above advantages may be improved when nitrogen atoms are contained together with boron atoms therein.

The amount of one kind selected from nitrogen atoms (N), and oxygen atoms (O) or the sum of the amounts for two kinds of these atoms to be contained in the photoconductive layer is preferably $5\times10^{-4}$ to 30 atomic %, more preferably, $1\times10^{-2}$ to 20 atomic %, and, most preferably, $2\times10^{-2}$ to 15 atomic %.

The amount of the hydrogen atoms (H), the amount of the halogen atoms (H) or the sum of the amounts for the hydrogen atoms and the halogen atoms (H+X) to be incorporated in the photoconductive layer is preferably 1 to 40 atomic %, more preferably, 5 to 30 atomic %.

The halogen atom (X) includes, specifically, fluorine, chlorine, bromine and iodine. And among these halogen atoms, fluorine and chlorine and particularly preferred.

The thickness of the photoconductive layer is an important factor in order for the photocarriers generated by the irradiation of light having desired spectrum characteristics to be effectively transported, and it is appropriately determined depending upon the desired purpose.

It is, however, also necessary that the layer thickness be determined in view of relative and organic relationships in accordance with the amounts of the halogen atoms and hydrogen atoms contained in the layer or the characteristics required in the relationship with the thickness of other layer. Further, it should be determined also in economical viewpoints such as productivity or mass productivity. In view of the above, the thickness of the photoconductive layer is preferably 1 to 100 μm, more preferably, 1 to 80 μm, and, most preferably, 2 to 50 μm.

Surface Layer 104 (or 1503)

The surface layer 104 (or 1503) having the free surface 105 (or 1504) is disposed on the photoconductive layer 103 (or 1502-2) to attain the objects chiefly of moisture resistance, deterioration resistance upon repeating use, electrical voltage withstanding property, use environmental characteristics and durability for the light receiving member for use in electrophotography according to this invention.

The surface layer is formed of the amorphous material containing silicon atoms as the constituent element which are also contained in the layer constituent amorphous material for the photoconductive layer, so that the chemical stability at the interface between the two layers is sufficiently secured.

Typically the surface layer is formed of an amorphous material containing silicon atoms, carbon atoms, and hydrogen atoms (hereinafter referred to as "A-$(Si_xC_{1-x})_yH_{1-y}$", $x>0$ and $y<1$).

It is necessary for the surface layer for the light receiving member for use in electrophotography according to this invention to be carefully formed in order for that layer to bring about the characteristics as required.

That is, a material containing silicon atoms (Si), carbon atoms (C) and hydrogen atoms (H) as the constituent elements is structually extended from a cyrstalline state to an amorphous state which exhibit electrophysically properties from conductiveness to semiconductiveness and insulativeness, and other properties from photoconductiveness to in photoconductiveness according to the kind of a material.

Therefore, in the formation of the surface layer, appropriate layer forming conditions are required to be strictly chosen under, which a desired surface layer composed of A-$(Si_xC_{1-x})_yH_{1-y}$ having the characteristics as required may be effectively formed.

For instance, in the case of disposing the surface layer with aiming chiefly at improvements in its electrical voltage withstanding property, the surface layer composed of A-$(Si_xC_{1-y})_y$:$H_{1-y}$ is so formed that it exhibits a significant electrical insulative behavior in use environment.

In the case of disposing the surface layer with aiming at improvements in repreating use characteristics and use environmental characteristics, the surface layer composed of A-$(Si_xC_{1-x})_yH_{1-y}$ is so formed that it has certain sensitivity to irradiated light although the electrical insulative property should be somewhat decreased.

The amount of carbon atoms and the amount of hydrogen atoms respectively to be contained in the surface layer of the light receiving member for use is electrophotography according to this invention are important factors as well as the surface layer forming conditions in order to make the surface layer accompanied with desired characteristics to attain the objects of this invention.

The amount of the carbon atoms (C) to be incorporated in the surface layer is preferably $1\times10^{-3}$ to 90 atomic %, and, most preferably, 10 to 80 atomic % respectively to the sum of the amount of the silicon atoms and the amount of the carbon atoms.

The amount of the hydrogen atoms to be incorporated in the surface layer is preferably $1\times10^{-3}$ to 40 atomic %, more preferably $5\times10^{-3}$ to 35 atomic %, and, most preferably, $1\times10^{-2}$ to 30 atomic % respectively to the sum of the amount of all the constituent atoms to be incorporated in the surface layer.

As long as the amount of the hydrogen atoms to be incorporated in the surface layer lies in the above-mentioned range, any of the resulting light receiving members for use in electrophotography becomes wealthy in significantly practically applicable characteristics and to excel the conventional light receiving members for use in electrophotography in every viewpoint.

For the incorporation of the hydrogen atoms in said amount in the surface layer, it can be carried out by appropriately controlling the related conditions such as the flow rate of a starting gaseous substance, the temperature of a substrate, discharging power and the gas pressure.

That is, in the case where the surface layer is formed of A-$(Si_xC_{1-x})_y$: $H_{1-y}$, the "x" is preferably 0.1 to 0.99999, more preferably 0.1 to 0.99, and, most preferably, 0.15 to 0.9. And the "y" is preferably 0.6 to 0.999 more preferably 0.65 to 0.995, and, most preferably, 0.7 to 0.99.

The thickness of the surface layer in the light receiving member according to this invention is appropriately determined depending upon the desired purpose.

It is, however, also necessary that the layer thickness be determined in view of relative and organic relationships in accordance with the amounts of the halogen atoms, hydrogen atoms and other kind atoms contained in the layer or the characteristics required in the relationship with the thickness of other layer. Further, it should be determined also in economical point of view such as productivity or mass productivity. In view of the above factors, the thickness of the surface layer is preferably 0.003 to 30 μm, more preferably, 0.004 to 20 μm, and, most preferably, 0.005 to 10 μm.

By the way, the thickness of the light receiving layer 100 constituted by the photoconductive layer 103 (or 1502-2 in FIG. 15) and the surface layer 104 (or 1503 in FIG. 15) in the light receiving member for use in electrophotography according to this invention is appropriately determined depending upon the desired purpose.

In any case, said thickness is appropriately determined in view of relative and organic relationships between the thickness of the photoconductive layer and that of the surface layer so that the various desired characteristics for each of the photoconductive layer and the surface layer in the light receiving member for use in electrophotography can be sufficiently brought about upon the use to effectively attain the foregoing objects of this invention.

And, it is preferred that the thicknesses of the photoconductive layer and the surface layer be determined so that the ratio of the former versus the latter lies in the range of some hundred times to some thousand times.

Specifically, the thickness of the light receiving layer 100 is preferably 3 to 100 μm, more preferably 5 to 70 μm, and, most preferably, 5 to 50 μm.

IR Layer 106

In the light receiving member for use in electrophotography of this invention, the IR layer 106 is formed of A-SiGE(H,X) or poly-SiGe(H,X).

When germanium atoms is incorporated in the IR layer, the light receiving member for use in electrophotography of this invention becomes more sensitive to light of wavelengths broadly ranging from short wavelength to long wavelength covering visible light and particularly it becomes suitable for the matching property with a semiconductor laser. And, it also becomes quickly responsive to light.

As for the germanium atoms to be contained in the IR layer, they may be distributed uniformly in its entire layer region or unevenly in the direction toward the layer thickness of its entire layer region.

However, in any case, it is necessary for the germanium atoms to be distributed uniformly in the direction parallel to the surface of the substrate in order to provide the uniformness of the characteristics to be brought out.

In one of the preferred embodiments, the germanium atoms are contained in such state that the distributing concentration of these atoms is changed in the way of being decreased from the layer region near the substrate toward the layer region near the charge injection inhibition layer. In this case, the affinity between the IR layer and the charge injection inhibition becomes excellent. And, as later detailed, when the distributing concentration of the germanium atoms is made significantly large in the layer region adjacent to the substrate, the IR layer becomes to substantially and completely absorb the light of long wavelength that can be hardly absorbed by the photoconductive layer in the case of using a semiconductor laser as the light source. As a result, the occurrence of the interference caused by the light reflection from the surface of the substrate can be effectively prevented.

For the amount of germanium atoms to be contained in the IR layer, it is properly determined according to desired requirements. However, it is preferably 1 to $1\times10^6$ atomic ppm, more preferably $10^2$ to $9.5\times10^5$ atomic ppm, and, most preferably, $5\times10^2$ to $8\times10^5$ atomic ppm based on the total amount of silicon atoms and germanium atoms.

Further, the IR layer may contain an element for controlling the conductivity.

As for the element for controlling the conductivity to be contained in said layer, the group III or Group V atoms can be used likewise in the case of the above-mentioned charge injection inhibition layer.

When the group III or group V atoms is incorporated in the IR layer, the inhibitation of a charge injection from the substrate, or the improvement in the transfer efficiency of an optically pumped charge is brought about.

For the amount of the group III or group V atoms, it is preferably $1\times10^{-2}$ to $5\times10^5$ atomic ppm, more preferably $5\times10^{-1}$ to $1\times10^4$ atomic ppm, and, most preferably, 1 to $5\times10^3$ atomic ppm.

Further more, the IR layer may contain at least one kind selected from nitrogen atoms, oxygen atoms and carbon atoms.

When at least one kind selected from nitrogen atoms, oxygen atoms and carbon atoms is incorporated in the IR layer, the bondability between the substrate and that layer or/and between that layer and the charge injection inhibition layer and the adjustment of band gap for that layer are effectively improved.

For the amount of at least one kind selected from nitrogen atoms, oxygen atoms and carbon atoms, it is preferably $1\times10^{-2}$ to 40 atoms %, more preferably $5\times10^{-2}$ to 30 atomic %, and, most preferably, $1\times10^{-1}$ to 25 atomic %.

And as for the thickness of the IR layer, it is preferably 30 Å to 50 μm, more preferably 40 Å to 40 μm. and, most preferably, 50 Å to 30 μm.

Contact Layer 107

The contact layer 107 of this invention is formed of an amorphous material containing silicon atoms, at least one kind selected from nitrogen atoms, oxygen atoms and carbon atoms, and if necessary, hydrogen atoms or/and halogen atoms.

Further, the contact layer may contain an element for controlling conductivity.

The main object of disposing the contact layer in the light receiving member of this invention is to enhance the bondability between the substrate and the charge injection inhibition layer or between the substrate and the IR layer. And, when the element for controlling the conductivity is incorporated in the contact layer, the transportation of a charge between the substrate and the charge injection inhibition layer is effectively improved.

In the light receiving member of this invention, the amount of nitrogen atoms, oxygen atoms, or carbon atoms to be incorporated in the contact layer is properly determined according to use purposes.

It is preferably $5\times10^{-4}$ to $7\times10$ atomic %, more preferably $1\times10^{-3}$ to $5\times10$ atomic %, and, most preferably, $2\times10^{-3}$ to $3\times10$ atomic %.

For the thickness of the contact layer, it is properly determined having a due regard to its bondability, charge transporting efficiency, and also to its producibility.

It is preferably $1\times10^{-2}$ to $1\times10$ μm, and, most preferably, $2\times10^{-2}$ to 5 μm.

As for the hydrogen atoms and halogen atoms to be optionally incorporated in the contact layer, the amount of hydrogen atoms or halogen atoms, or the sum of the amount of hydrogen atoms and the amount of halogen atoms in the contact layer is preferably $1\times10^1$ to $7\times10$ atomic %, more preferably $5\times10^{-1}$ to $5\times10$ atomic %, and, most preferably, 1 to $3\times10$ atomic %.

Preparation of the constituent layers other than the foregoing charge injection inhibition layer Each of the foregoing photoconductive layer, surface layer, IR layer and conduct layer can be properly prepared in accordance with the foregoing method employed for the preparation of the charge injection inhibition layer.

However, in the case where the layer is one that is constituted with not a polycrystalline material but an amorphous material such as A-Si(H,X) for instance, it is necessary for the layer forming conditions therefor such as the flow ratio between a precursor to be used and an active species to be used at the time of being introduced into the film deposition space, the temperature of a substrate and other related parameters to be independently determined. to be different from those for the preparation of the charge injection inhibition layer.

For instance, in the case of continuously preparing the photoconductive layer or other layer following the formation of the charge injection inhibition layer, the temperature of the substrate is adjusted to be lower than that for the formation of the charge injection inhibition layer i.e. preferably 300 to 100° C. lower, and more preferably 400° C. to 200° C. lower.

And the flow ratio between the precursor and the active species at the time of being introduced into the film deposition space is appropriately determined in accordance with the organic relationships between the related parameters, for example, the relationship between the characteristics required for the layer to be formed and the temperature of the substrate.

In any case, the precursor generating raw material and the active species generating raw material to be used can be properly selected from those mentioned in the case of the preparation of the charge injection inhibition layer.

Each of the foregoing photoconductive layer, IR layer and contact layer can be also prepared by vacuum deposition method utilizing the discharge phenomena such as glow discharging, sputtering and ion plating methods wherein relevant gaseous starting materials are selectively used.

These production methods are properly used selectively depending on the factors such as the manufacturing conditions, the installation cost required, production scale and properties required for the light receiving members to be prepared. The glow discharging method or sputtering method is suitable since the control for the condition upon preparing the light receiving members having desired properties are relatively easy, and hydrogen atoms, halogen atoms and other atoms can be introduced easily together with silicon atoms. The glow discharging method and the sputtering method may be used together in one identical system.

Basically, when the photoconductive layer constituted with A-Si(H,X) is formed, for example, by the glow discharging process, gaseous starting material capable of supplying silicon atoms (Si) are introduced together with gaseous starting material for introducing hydrogen atoms (H) and/or halogen atoms (X) into a deposition chamber the inside pressure of which can be reduced, glow discharge is generated in the deposition chamber, and a layer composed of A-Si(H,X) is formed on the surface of a substrate placed in a deposition chamber.

In the case of forming such layer by the reactive sputtering process, it is formed by using a Si target and by introducing a gas or gases material capable of supplying halogen atoms (X) or/and hydrogen atoms (H), if necessary, together with an inert gas such as He or Ar into a sputtering deposition chamber to thereby form a plasma atmosphere and then sputtering the Si target.

In the case of forming the IR layer constituted with A-SiGe(H,X) by the glow discharging process, gaseous starting material capable of supplying silicon atoms (Si) is introduced together with gaseous starting material capable of supplying germanium atoms (Ge), and if necessary gaseous starting material for introducing hydrogen atoms (H) and/or halogen atoms (X) into a deposition chamber the inside pressure of which can be reduced, glow discharge is generated in the deposition chamber, and a layer composed of A-SiGe(H,X) or poly-Si(H,X) is formed on the surface of the substrate placed in the deposition chamber.

To form the JR layer of A-SiGe(H,X) by the reactive sputtering process, a single target composed of silicon, or two targets (the said target and a target composed of germanium), further a single target composed of silicon and germanium is subjected to sputtering in atmosphere of an inert gas such as He or Ar, and if necessary gaseous starting material capable of supplying germanium atoms diluted with an inert gas such as He or Ar and/or gaseous starting material for introducing hydrogen atoms (H) and/or halogen atoms (X) are introduced into the sputtering deposition chamber thereby forming a plasma atmosphere with the gas.

The gaseous starting material for supplying Si can include gaseous orgasifiable silicon hydrides (silanes) such as $SiH_4$, $Si_2H_6$, $Si_3H_8$, $Si_4H_{10}$, etc., $SiH_4$ and $Si_2H_6$ being particularly preferred in view of the easy layer forming work and the good efficiency for the supply of Si.

The gaseous starting material for supplying Ge can include gaseous or gasifiable germanium hydrides such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, and $Ge_9H_{20}$, etc., $GeH_4$, $Ge_2H_6$, and $Ge_3H_8$ being particularly preferred in view of the easy layer forming work and the good efficiency for the supply of Ge.

Further, various halogen compounds can be mentioned as the gaseous starting material for introducing the halogen atoms and gaseous or gasifiable halogen compounds, for example, gaseous halogen, halides, inter-halogen compounds and halogen-substituted silane derivatives are preferred. Specifically, they can include halogen gas such as of fluorine, chlorine, bromine, and iodine; inter-halogen compounds such as BrF, ClF, $ClF_3$, $BrF_2$, $BrF_3$, $IF_7$, ICl, IBr, etc.; and silicon halides such as $SiF_4$, $Si_2F_6$, $SiCl_4$, and $SiBr_4$.

The use of the gaseous or gasifiable silicon halides as described above for forming a light receiving layer composed of A-Si containing halogen atoms as the constituent atoms by the glow discharging process is particularly advantageous since such layer can be formed with no additional use of gaseous starting material for supplying Si such as silicon hydride.

And, basically, in the case of forming a light receiving layer containing halogen atoms by the glow discharging process, for example, a mixture of a gaseous silicon halide substance as the starting material for supplying Si and a gas such as Ar, $H_2$ and He is introduced into the deposition chamber having a substrate in a predetermined mixing ratio and at a predetermined gas flow rate, and the thus introduced gases are exposed to the action of glow discharge to thereby cause a plasma resulting in forming said layer on the substrate. And, for incorporating hydrogen atoms in said layer, an appropriate gaseous starting material for supplying hydrogen atoms can be additionally used.

In the case of forming the IR layer, the above-mentioned halides or halogen-containing silicon compounds can be used as the effective gaseous starting material for supplying halogen atoms. Other examples of the starting material for supplying halogen atoms can include germanium hydride halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, and $GeH_3I$; and germanium halides such as $GeF_4$, $GeCl_4$, $GeBr_4$, $GeI_4$, $GeF_2$, $GeCl_2$, $GeBr_2$, and $GeI_2$. They are in the gaseous form or gasifiable substances.

And in any case, one of these gaseous or gasifiable starting materials or a mixture of two or more of them in a predetermined mixing ratio can be selectively used.

As above mentioned, in the case of forming a layer composed constituted with, for example, A-Si(H,X) by the reactive sputtering process, such layer is formed on the substrate by using an Si target and sputtering the Si target in a plasma atmosphere.

And, in order to form such layer by the ion-plating process, the vapor of polycrystal silicon or single crystal silicon is allowed to pass through a desired gas plasma atmosphere. The silicon vapor is produced by heating the polycrystal silicon or single crystal silicon held in a boat. The heating is accomplished by resistance heating or in accordance with the electron beam method (E.B. method).

In either case where the sputtering process or the ion-plating process is employed, the layer may be incorporated with halogen atoms by introducing one of the above-mentioned gaseous halides or halogen-containing silicon compounds into the deposition chamber in which a plasma atmosphere of the gas is produced. In the case where the layer is incorporated with hydrogen atoms in accordance with the sputtering process, a feed gas to liberate hydrogen is introduced into the deposition chamber in which a plasma atmosphere of the gas is produced. The feed gas to liberate hydrogen atoms includes $H_2$ gas and the above-mentioned silanes.

As for the gaseous or gasifiable starting material for incorporating halogen atoms in the IR layer or photoconductive layer, the foregoing halide, halogen-containing silicon compound or halogen-containing germanium compound can be effectively used. Other effective examples of said material can include hydrogen halides such as HF, HCl, HBr and HI and halogen-substituted silanes such as $SiH_2F_2$, $SiH_2I_2$, $SiH_2Cl_2$, $SiHCl_3$, $SiH_2Br_2$ and $SiHBr_3$, which contain hydrogen atom as the constituent element and which are in the gaseous state or gasifiable substances. The use of the gaseous or gasifiable hydrogen-containing halides is particularly advantageous since, at the time of forming a light receiving layer, the hydrogen atoms, which are extremely effective in view of controlling the electrical or photoelectrographic properties, can be introduced into that layer together with halogen atoms.

The structural introduction of hydrogen atoms into the layer can be carried out by introducing, in addition to these gaseous starting materials, $H_2$, or silicon hydrides such as $SiH_4$, $SiH_6$, $Si_3H_6$, $Si_4H_{10}$, etc. into the deposition chamber together with a gaseous or gasifiable siliconcontaining substance for supplying Si, and producing a plasma atmosphere with these gases therein.

The amount of the hydrogen atoms (H) and/or the amount of the halogen atoms (X) to be contained in the layer are adjusted properly by controlling related conditions, for example, the temperature of a substrate, the amount of a gaseous starting material capable of supplying the hydrogen atoms or the halogen atoms into the deposition chamber and the electric discharging power.

In order to incorporate the group III atoms or the group V atoms, and, oxygen atoms, nitrogen atoms or carbon atoms in the IR layer or the photoconductive layer using the glow discharging process, reactive sputtering process or ion plating process, the starting material capable of supplying the group III or group V atoms, and, the starting material capable of supplying oxygen atoms, nitrogen atoms or carbon atoms are selectively used together with the starting material for forming the IR layer or the photoconductive layer upon forming such layer while controlling the amount of them in that layer to be formed.

As the starting material to introduce the atoms (O,N,C), many gaseous or gasifiable substances containing any of oxygen, carbon, and nitrogen atoms as the constituent atoms can be used. Likewise, as for the starting material to introduce the group III or group V atoms, many gaseous or gasifiable substances can be used.

For example, referring to the starting material for introducing oxygen atoms, most of those gaseous or gasifiable materials which contain at least oxygen atoms as the constituent atoms can be used.

And, it is possible to use a mixture of a gaseous starting material containing silicon atoms (Si) as the constituent atoms, a gaseous starting material containing oxygen atoms (O) as the constituent atom and, as required, a gaseous starting material containing hydrogen atoms (H) and/or halogen atoms (X) as the constituent atoms in a desired mixing ratio, a mixture of gaseous starting material containing silicon atoms (Si) as the constituent atoms and a gaseous starting material containing oxygen atoms (O) and hydrogen atoms (H) as the constituent atoms in a desired mixing ratio, or a mixture of gaseous starting material containing silicon atoms (Si) as the constituent atoms and a gaseous starting material containing silicon atoms (Si), oxygen atoms (O) and hydrogen atoms (H) as the constituent atoms.

Further, it is also possible to use a mixture of a gaseous starting material containing silicon atoms (Si) and hydrogen atoms (H) as the constituent atoms and a gaseous starting material containing oxygen atoms (O) as the constituent atoms.

Specifically, there can be mentioned, for example, oxygen ($O_2$), ozone ($O_3$), nitrogen monoxide (NO), nitrogen dioxide ($NO_2$), dinitrogen oxide ($N_2O$), dinitrogen trioxide ($N_2O_3$), dinitrogen tetraoxide ($N_2O_4$), dinitrogen pentoxide ($N_2O_5$), nitrogen trioxide ($NO_3$), lower siloxanes comprising silicon atoms (Si), oxygen atoms (O) and hydrogen atoms (H) as the constituent atoms, for example, disiloxane ($H_3SiOSiH_3$) and trisiloxane ($H_3SiOSiH_2OSiH_3$), etc.

Likewise, as the starting material for introducing nitrogen atoms, most of gaseous or gasifiable materials which contain at least nitrogen atoms as the constituent atoms can be used.

For instance, it is possible to use a mixture of a gaseous starting material containing silicon atoms (Si) as the constituent atoms, a gaseous starting material containing nitrogen atoms (N) as the constituent atoms and, optionally, a gaseous starting material containing hydrogen atoms (H) and/or halogen atoms (X) as the constituent atoms in a desired mixing ratio, or a mixture of a starting gaseous material containing silicon atoms (Si) as the constituent atoms and a gaseous starting material containing nitrogen atoms (N) and hydrogen atoms (H) as the constituent atoms also in a desired mixing ratio.

Alternatively, it is also possible to use a mixture of a gaseous starting material containing nitrogen atoms (N) as the constituent atoms and a gaseous starting material containing silicon atoms (Si) and hydrogen atoms (H) as the constituent atoms.

The starting material that can be used effectively as the gaseous starting material for introducing the nitrogen atoms (N) used upon forming the layer containing nitrogen atoms can include gaseous or gasifiable nitrogen, nitrides and nitrogen compounds such as azide compounds comprising N as the constituent atoms or N and H as the constituent atoms, for example, nitrogen ($N_2$), ammonia ($NH_3$), hydrazine ($H_2NNH_2$). hydrogen azide ($HN_3$) and ammonium azide ($NH_4N_3$). In addition, nitrogen halide compounds such as nitrogen trifluoride ($F_3N$) and nitrogen tetrafluoride ($F_4N_2$) can also be mentioned in that they can also introduce halogen atoms (X) in addition to the introduction of nitrogen atoms (N).

Further, as for the starting material for introducing carbon atoms, gaseous or gasifiable materials containing carbon atoms as the constituent atoms can be used.

And it is possible to use a mixture of gaseous starting material containing silicon atoms (Si) as the constituent atoms, gaseous starting material containing carbon atoms (C) as the constituent atoms and, optionally, gaseous starting material containing hydrogen atoms (H) and/or halogen atoms (X) as the constituent atoms in a desired mixing ratio, a mixture of gaseous starting material containing silicon atoms (Si) as the constituent atoms and gaseous starting material containing carbon atoms (C) and hydrogen atoms (H) as the constituent atoms also in a desired mixing ratio, or a mixture of gaseous starting material containing silicon atoms (Si) as the constituent atoms and gaseous starting material comprising silicon atoms (Si).

Those gaseous starting materials that are effectively usable herein can include gaseous silicon hydrides containing carbon atoms (C) and hydrogen atoms (H) as the constituent atoms, such as silanes, for example, $SiH_4$, $Si_2H_6$, $Si_3H_8$ and $Si_4H_{10}$, as well as those containing carbon atoms (C) and hydrogen atoms (H) as the constituent atoms, for example, saturated hydrocarbons of 1 to 4 carbon atoms, ethylenic hydrocarbons of 3 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition to these gaseous starting materials, $H_2$ can of course be used as the gaseous starting material for introducing hydrogen atoms (H).

In order to form the IR layer or the photoconductive layer incorporated with the group III or group V atoms using the glow discharging process, reactive sputtering process or ion plating process, the starting material for introducing the group III or group V atoms is used together with the starting material for forming such upon forming that layer while controlling the amount of them in the layer to be formed.

For instance, in the case of forming a layer composed of A-Si(H,X) containing the group III or group V atoms by using the glow discharging, the starting gases material for forming such layer are introduced into a deposition chamber in which a substrate being placed, optionally being mixed with an inert gas such as Ar or He in a predetermined mixing ratio, and the thus introduced gases are exposed to the action of glow discharge to thereby cause a gas plasma resulting in forming such layer on the substrate.

Referring specifically to the boron atom introducing materials as the starting material for introducing the group III atoms, they can include boron hydrides such as $B_2H_6$, $B_4H_{10}$, $B_5H_9$, $B_5H_{11}$, $B_6H_{10}$, $B_6H_{12}$ and $B_6H_{14}$ and boron halides such as $BF_3$, $BCl_3$ and $BBr_3$. In addition, $AlCl_3$, $CaCl_3$, $Ga(CH_3)_2$, $InCl_3$, $TlCl_3$ and the like can also be mentioned.

Referring to the starting material for introducing the group V atoms and, specifically, to the phosphorus atom introducing materials, they can include, for example, phosphor hydrides such as $PH_3$ and $P_2H_6$ and phosphor halide such as $PH_4I$, $PF_3$, $PF_5$, $PCl_3$, $PCl_5$, $PBr_3$, $PBr_5$ and $PI_3$. In addition, $AsH_3$, $AsF_5$, $AsCl_3$, $AsBr_3$, $AsF_3$, $SbH_3$, $SbF_3$, $SbF_5$, $SbCl_3$, $SbCl_5$, $BiH_3$, $SiCl_3$ and $BiBr_3$ can also be mentioned as the effective starting material for introducing the group V atoms.

The amount of the group III or group V atoms to be contained in the IR layer or the photoconductive layer are adjusted properly by controlling the related conditions, for example, the temperature of a substrate, the amount of a gaseous starting material capable of supplying the group III or group V atoms, the gas flow rate of such gaseous starting material, the discharging power, the inner pressure of the deposition chamber, etc.

The conditions upon forming the constituent layers of the light receiving member of the invention, for example, the temperature of the substrate the gas pressure in the deposition chamber, and the electric discharging power are important factors for obtaining the light receiving member having desired properties and they are properly selected while considering the function of each of the layers to be formed. Further, since these layer forming conditions may be varied depending on the kind and the amount of each of the atoms contained in the layer, the conditions have to be determined also taking the kind or the amount of the atoms to be contained into consideration.

In the case of forming the photoconductive layer which is constituted with an A-Si material, and the IR layer which is constituted also with an A-Si material the temperature of the substrate is usually from 50° to 350° C., preferably, from 50° to 300° C., most suitably 100° to 250° C.; the gas pressure in the deposition chamber is usually from $1\times10^{-2}$ to 5 Torr, preferably, from $1\times10^{-2}$ to 3 Torr, most suitably from $1\times10^{-1}$ to 1 Torr; and the electrical discharging power is preferably from 10 to 1000 W/cm$^2$, and more preferably, from 20 to 500 W/cm$^2$.

In any case, the actual conditions for forming the layer such as temperature of the support, discharging power and the gas pressure in the deposition chamber cannot usually be determined with ease independent of each other. Accordingly, the conditions optimal to the layer formation are desirably determined based on relative and organic relationships for forming the corresponding layer having desired properties.

The surface layer can be properly prepared by vacuum deposition method utilizing the discharge phenomena such as flow discharging, sputtering or ion plating wherein relevant gaseous starting materials are selectively used as well as in the above-mentioned cases for preparing the photoconductive layer.

However, the glow discharging method or sputtering method is suitable since the control for the condition upon preparing the surface layer having desired properties are relatively easy, and hydrogen atoms and carbon atoms can be introduced easily together with silicon atoms. The glow discharging method and the sputtering method may be used together on identical system.

Basically, when a layer constituted with A-$(si_xC_{1-x})_y$: $H_{1-y}$ is formed, for example, by the glow discharging method, gaseous starting material capable of supplying silicon atoms (Si) are introduced together with a gaseous starting material for introducing hydrogen atoms (H) and/or halogen atoms (X) into a deposition chamber the inside pressure of which can be reduced, glow discharge is generated in the deposition chamber, and a layer constituted with A-$(Si_xC_{1-x})_y$: $H_{1-y}$ is formed on the surface of a substrate placed in the deposition chamber.

As for the gaseous starting materials for supplying silicon atoms (Si) and/or hydrogen atoms (H), the same gaseous materials as mentioned in the above cases for preparing photoconductive layer can be used as long as they do not contain any of halogen atoms, nitrogen atoms and oxygen atoms.

That is, the gaseous starting material usable for forming the surface layer can include almost any kind of gaseous or gasifiable materials as far as it contains one or more kinds selected from silicon atoms, hydrogen atoms and carbon atoms as the constituent atoms.

Specifically, for the preparation of the surface layer, it is possible to use a mixture of gaseous starting material containing silicon atoms (Si) as the constituent atoms, gaseous starting material containing carbon atoms (C) as the constituent atoms and, optionally, gaseous starting material containing hydrogen atoms (H) as the constituent atoms in a desired mixing ratio, a mixture of gaseous starting material containing silicon atoms (Si) as the constituent atoms and gaseous starting material containing carbon atoms (C) and hydrogen atoms (H) as the constituent atoms also in a desired mixing ratio, or a mixture of gaseous starting material containing silicon atoms (Si) as the constituent atoms and gaseous starting material comprising silicon atoms (Si) in the glow discharging process as described above.

Those gaseous starting materials that are effectively usable herein can include gaseous silicon hydrides containing carbon atoms (C) and hydrogen atoms (H) as the constituent atoms, such as silanes, for example, $SiH_4$, $Si_2H_6$, $Si_3H_8$ and $Si_4H_{10}$, as well as those containing carbon atoms (C) and hydrogen atoms (H) as the constituent atoms, for example, saturated hydrocarbons of 1 to 4 carbon atoms, ethylenic hydrocarbons of 2 to 4 carbon atoms and acetylenic hydrocarbons of 2 to 3 carbon atoms.

Specifically, the saturated hydrocarbons can include methane ($CH_4$), ethane ($C_2H_6$), propane ($C_3H_8$), n-butane (n-$C_4H_{10}$) and pentane ($C_5H_{12}$), the ethylenic hydrocarbons can include ethylene ($C_2H_4$), propylene ($C_3H_6$), butene-1 ($C_4H_8$), butene-2 ($C_4H_8$), isobutylene ($C_4H_8$) and pentene ($C_5H_{10}$) and the acetylenic hydrocarbons can include acetylene ($C_2H_2$), methylacetylene ($C_3H_4$) and butine ($C_4H_6$).

The gaseous starting material containing silicon atoms (Si), carbon atoms (C) and hydrogen atoms (H) as the constituent atoms can include silicided alkyls, for example, $Si(CH_3)_4$ and $Si(C_2H_5)_4$. In addition to these gaseous starting materials, $H_2$ can of course be used as the gaseous starting material for introducing hydrogen atoms (H).

In the case of forming the surface layer by way of the sputtering process, it is carried out by using a single crystal or polycrystalline Si wafer, a C (graphite) wafer or a wafer containing a mixture of Si and C as a target and sputtering them in a desired gas atmosphere.

In the case of using, for example, an Si wafer as a target, a gaseous starting material for introducing carbon atoms (C) is introduced while being optionally diluted with a dilution gas such as Ar and He into a sputtering deposition chamber thereby forming gas plasmas with these gases and sputtering the Si wafer.

Alternatively, in the case of using Si and C as individual targets or as a single target comprising Si and C in admixture, gaseous starting material for introducing hydrogen atoms as the sputtering gas is optionally diluted with a dilution gas, introduced into a sputtering deposition chamber thereby forming gas plasmas and sputtering is carried out. As the gaseous starting material for introducing each of the atoms used in the sputtering process, those gaseous starting materials used in the glow discharging process as described above may be used as they are.

The conditions upon forming the surface layer constituted with an amorphous material composed of A-$(Si_xC_{1-x})_y$: $H_{1-y}$, for example, the temperature of the substrate, the gas pressure in the deposition chamber and the electric discharging power are important factors for obtaining a desirable surface layer having desired properties and they are properly selected while considering the functions of the layer to be formed. Further, since these layer forming conditions may be varied depending on the kind and the amount of each of the atoms contained in the light receiving layer, the conditions have to be determined also taking the kind or the amount of the atoms to be contained into consideration.

Specifically, the temperature of the substrate is preferably from 50° to 350° C. and, most preferably, from 100° to 300° C. The gas pressure in the deposition chamber is preferably from 0.01 to 1 Torr and, most preferably, from 0.1 to 0.5 Torr. Further, the electrical discharging power is preferably from 10 to 1000 W/cm$^2$, and, most preferably, from 20 to 500 W/cm$^2$.

However, the actual conditions for forming the surface layer such as the temperature of a substrate, discharging power and the gas pressure in the deposition chamber can not usually be determined with ease independent of each other. Accordingly, the conditions optimal to the formation of the surface layer are desirably determined based on relative and organic relationships for forming the surface layer having desired properties.

PREFERRED EMBODIMENT OF THE INVENTION

The advantages of this invention are now described in more detail by reference to the following Examples, which are provided merely for illustrative purposes only, and are not intended to limit the scope of this invention.

Figure 18:
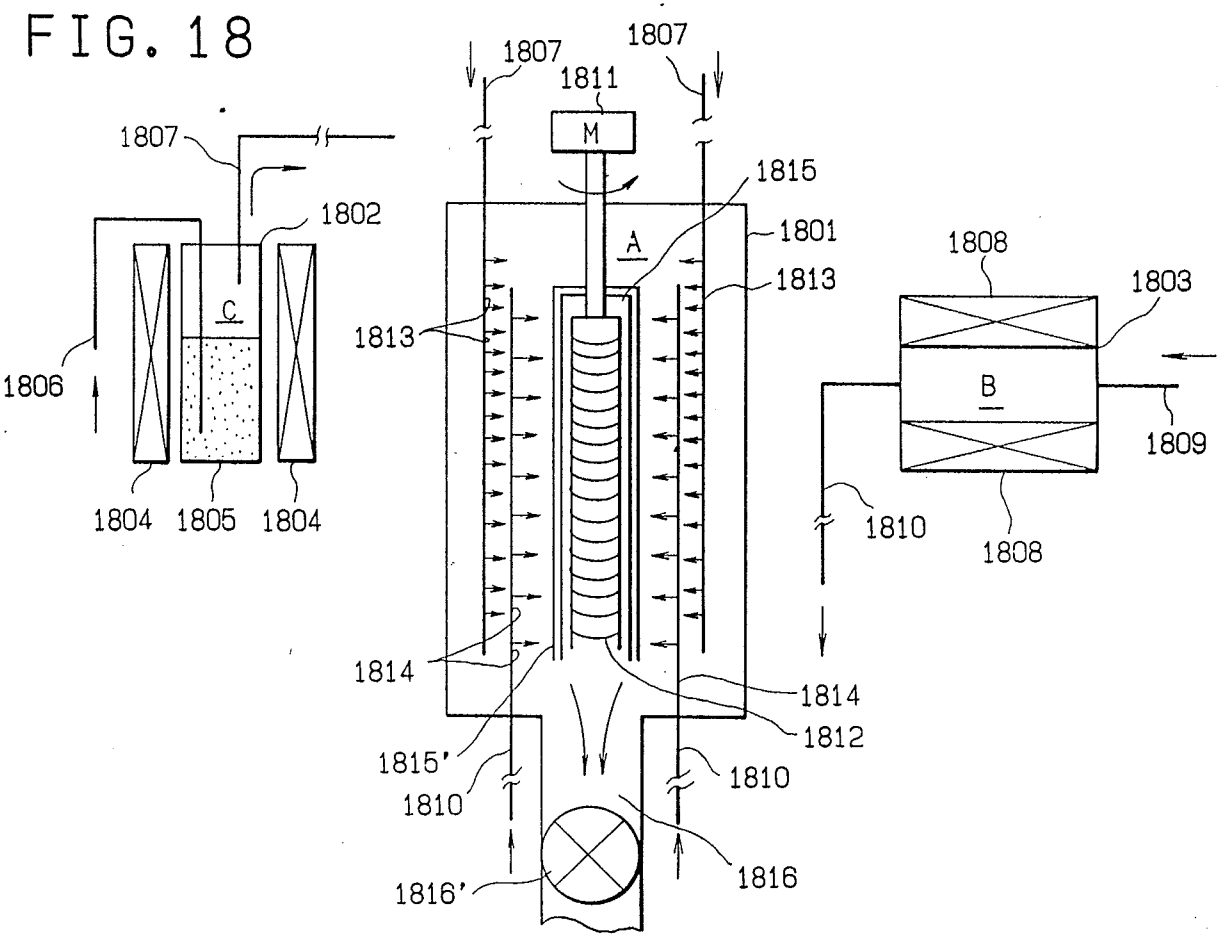
FIG. 18 and FIG. 19 are schematic explanatory views respectively of a representative fabrication apparatus for preparing the light receiving member for use in electrophotography according to this invention.
Figure 19:
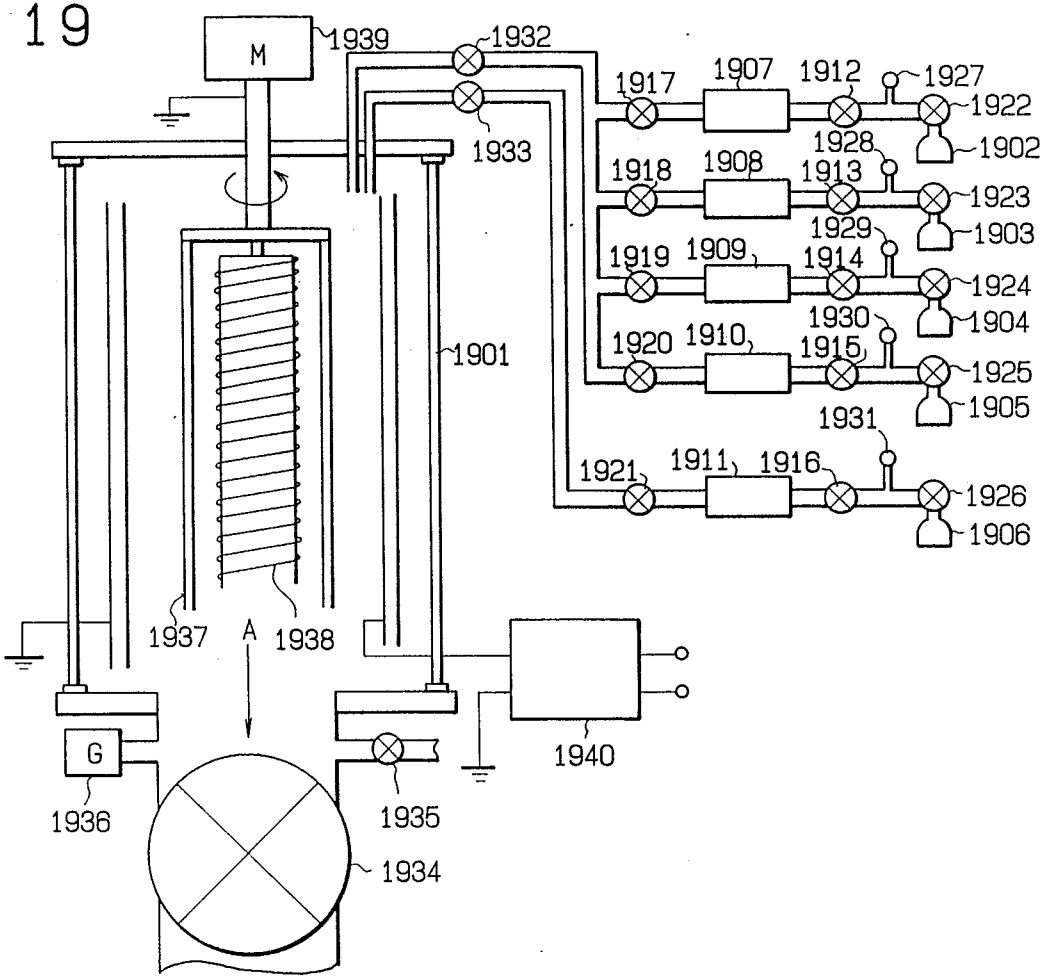

FIGS. 18 and 19 are schematic views illustrating representative apparatuses for producing a light receiving member for use in electrophotography according to this invention respectively.

In FIG. 18, 1801 stands for a film deposition chamber having a inner space A in which a substrate holder 1815 for substrate 1815' having electric heater 1812 connected to a power source (not shown) is provided. The film deposition chamber 1801 is provided with an exhaust pipe 1816 connected through main valve 1816' to an exhaust pump (not shown) serving to break the vacuum in the film deposition chamber.

1811 stands for motor which is mechanically connected to the substrate holder 1815 so as to rotate it during film forming operation. The film deposition chamber 1801 are provided with precursor feeding pipes 1807, 1807 having a plurality of gas liberation holes 1813, 1813, --- and active species feeding pipes 1810, 1810 having a plurality of gas liberation holes 1814, 1814, ---. The precursor feeding pipes 1807, 1807 are connected through valve means (not shown) to precursor generation chamber 1802 having infrared heating furnace or microwave power source 1804 being mounted sourrounding the outer wall thereof. 1806 stands for a gas supplying pipe for a raw material gas from a gas reservoir (not shown) which reacts with raw material solid particles such as Si solid particles 1805 to generate a precursor, which are stored leaving a space C in the precursor generation chamber 1802. It is possible to use a precursor generating raw material gas in stead of the raw material solid particles. In that case, the inner space of the precursor generation chamber is vacanted and a precursor generating raw material gas is fed thereinto.

The active species feeding pipes 1810, 1810 are connected through valve means (not shown) to active species generation chamber 1803 having a inner space B. The active species generation chamber 1803 is provided with microwave power source 1808 being mounted surrounding the outer wall thereof. 1809 stands for a feeding pipe for a active species generating raw material gas from a gas reservoir (not shown).

The distance between the gas liberation holes 1813, 1813 --- and the substrate 1815' and the distance between the gas liberation holes 1814, 1814, --- and the substrate 1815' are properly determined depending upon the kind or the structure of the apparatus to be employed. As far as the apparatus shown in FIG. 18 is concerned, they are determined to be in the range between 10 and 150 mm.

The apparatus shown in FIG. 18 typically serves to form the charge injection layer of the light receiving member for use in electrophotography of this invention. But it is of course possible to form other layers such as photoconductive layer, surface layer, etc. of the light receiving member for use in electrophotography of this invention using the apparatus shown in FIG. 18.

In a representative operation to form a layer to be the charge injection inhibition layer using the apparatus shown in FIG. 18, a Al-cylinder as the substrate 1815' is disposed on the substrate holder 1815. A predetermined amount of solid Si-particles is placed in the inner space of the precursor generation chamber 1802 while leaving a proper vacant space C. The solid Si-particles are heated to 600° to 1200° C., preferably 600° to 800° C. by activating the furnace 1804 and an appropriate gas such as $SiF_4$ gas is introduced through the feeding pipe 1806 thereinto. to thereby generate $SiF_2$* to be the precursor. The thus generated $SiF_2$* is successively fed through the precursor feeding pipes 1807, 1807 and gas liberation holes 1813, 1813—into the film forming space A of the film deposition chamber 1801.

In parallel, $H_2$ gas as the active species generating raw material is introduced through the feeding pipe 1809 into the active species generation space B of the active species generation chamber 1803 followed by exposing to a discharge energy from the microwave power source 1808 to thereby generate H* to be the active species, which is followed by introducing into the film forming space A of the film deposition chamber 1801. It is possible to feed a raw material gas to impart an impurity such as $PF_5$ gas or $BF_3$ or/and a gaseous substance containing at least one kind selected from oxygen atom, nitrogen atom and carbon atom such as $NO_2$ gas and CO gas in case where necessary. In that case, the shorter the length for the part having gas liberation holes 1814, 1814,—of the active species feeding pipe 1810 to be situated within the film forming space A the better in the view points of maintaining the utilization efficiency of the active species. And during the film forming operation, the substrate holder 1815 is rotated by the action of the motor 1811, the substrate 1815' is maintained at a predetermined temperature by the action of the heater 1812 and an exhaust gas is exhausted through the exhaust pipe 1816 by regulating the main valve 1816'.

In this way, not only the charge injection inhibition layer composed of a polycrystalline material or other layers of the light receiving member for use in electrophotography according to this invention can be formed on the substrate.

The thicknesswise distribution of the impurity, oxygen atom, nitrogen atom or carbon atom in the corresponding layer when they are incorporated therein can be controlled appropriately by diversifying the amount of the raw material gas therefor to be fed into the film forming space A.

The apparatus shown in FIG. 19 is suited for the formation of other layers than the charge injection inhibition layer of the light receiving member for use in electrophotography according to this invention.

Explanation will be hereunder made for the formation of the photoconductive layer and the surface layer of the light receiving member for use in electrophotography according to this invention using the apparatus shown in FIG. 19.

Gas reservoirs 1902, 1903, 1904, 1905, and 1906 illustrated in the figure are charged with gaseous starting materials for forming the respective layers in the light receiving member for use in electrophotography according to this invention, that is, for instance, $SiH_4$ gas (99.999% purity) in the reservoir 1902, $B_2H_6$ gas (99.999% purity) diluted with $H_2$ (referred to as "$B_2H_{6/H2}$") in the reservoir 1903, $H_2$ gas (99.99999% purity) in the reservoir 1904, NO gas (99.999% purity) in the reservoir 1905, and $CH_4$ gas (99.99% purity) in the reservoir 1906.

Prior to the entrance of these gases into a reaction chamber 1901, it is confirmed that valves 1922–1926 for the gas reservoirs 1902–1906 and a leak valve 1935 are closed and that inlet valves 1912 to 1916, exit valves 1917 to 1921, and sub-valves 1932 and 1933 are opened. Then, a main valve 1934 is at first opened to evacuate the inside of the reaction chamber 1901 and gas piping.

Then, upon observing that the reading on the vacuum 1936 became about $5\times10^{-6}$ Torr, the sub-valves 1932 and 1933 and the exit valves 1917 through 1921 are closed.

Now, reference is made to an example in the case of forming the photoconductive layer on an Al cylinder as a substrate 1937.

Firstly, $SiH_{4\ gas}$ from the gas reservoir 1902, $B_2H_6/H_2$ gas from the gas reservoir 1903, $H_2$ gas from the gas reservoir 1904, and NO gas from the gas reservoir 1905 are caused to flow into mass flow controllers 1907, 1908, 1909, and 1910 respectively by opening the inlet valves 1912, 1913, 1914, and 1915, controlling the pressure of exit pressure gauges 1927, 1928, 1929, and 1930 to 1 kg/cm$^2$. Subsequently, the exit valves 1917, 1918, 1919, and 1920, and the subvalve 1932 are gradually opened to enter the gases into the reaction chamber 1901. In this case, the exit valves 1917, 1918, 1919, and 1920 are adjusted so as to attain a desired value for the ratio among the $SiH_4$ gas flow rate, NO gas flow rate, $CH_4$ gas flow rate, and $B_2H_6/H_2$ gas flow rate, and the opening of the main valve 1934 is adjusted while observing the reading on the vacuum gauge 1936 so as to obtain a desired value for the pressure inside the reaction chamber 1901. Then, after confirming that the temperature of the 1937 has been set by a heater 1948 within a range from 50° to 350° C., a power source 1940 is set to a predetermined electrical power to cause glow discharging in the reaction chamber 1901 while controlling the flow rates of NO gas and/or $B_2H_6/H_2$ gas in accordance with a previously designed variation coefficient curve by using a microcomputer (not shown), to thereby form the photoconductive layer containing oxygen atoms and boron atoms on the substrate cylinder 1937.

In the case where halogen atoms are incorporated in the photoconductive layer, for example, $SiF_4$ gas is fed into the reaction chamber 1901 in addition to the gases as mentioned above.

And it is possible to further increase the layer forming speed according to the kind of a gas to be selected. For example, in the case where the photoconductive layer is formed using $Si_2H_6$ gas in stead of the $SiH_4$ gas, the layer forming speed can be increased by a few holds and as a result, the layer productivity can be rised.

In order to form the surface layer on the resulting photoconductive layer, for example, $SiH_4$ gas, $CH_4$ gas and if necessary, a dilution gas such as $H_2$ gas are introduced into the reaction chamber 1901 by operating the corresponding valves in the same manner as in the case of forming the photoconductive layer, and glow discharging is caused therein under predetermined conditions to thereby form the surface layer.

In that case, the amount of the carbon atoms to be incorporated in the surface layer can be properly controlled by appropriately changing the flow rate for the $SiH_4$ gas and that for the $CH_4$ gas respectively to be introduced into the reaction chamber 1901. As for the amount of the hydrogen atoms to be incorporated in the surface layer, it can be properly controlled by appropriately changing the flow rate of the $H_2$ gas to be introduced into the reaction chamber 1901.

All of the exit valves other than those required for upon forming the respective layers are of course closed. Further, upon forming the respective layers, the inside of the system is once evacuated to a high vacuum degree as required by closing the exit valves 1917 through 1921 while entirely opening the sub-valve 1932 and entirely opening the main valve 1934.

Further, during the layer forming operation, the Al cylinder as substrate 1937 is rotated at a predetermined speed by the action of the motor 1939.

In this invention, as above-mentioned, it is possible to form all the constituent layers for the light receiving layer of the light receiving member according to this invention using the apparatus shown in FIG. 18.

However, in the typical embodiment of this invention, the charge injection inhibition layer is formed using the apparatus shown in FIG. 18 and the remaining layers are formed using the apparatus shown in FIG. 19.

In that case, after forming the charge injection inhibition layer on the substrate in the apparatus shown in FIG. 18, the resultant substrate having the charge injection inhibition layer thereon is taken from the apparatus into a vacuum transportation device and set to the substrate holder of the apparatus shown in FIG. 19 while the vacuum atmosphere bing maintained. Then the film forming operation of forming the photoconductive layer thereon is started.

In an alternative, it is possible that the apparatus shown in FIG. 18 and the apparatus shown in FIG. 19 are connected with an appropriate gate valve means (not shown) so that the substrate can be transferred through the gate valve means from the reaction chamber of the former apparatus to the reaction chamber of the latter apparatus. Using this modified apparatus, the productivity of the light receiving member for use in electrophotography may be more facilitated.

In another alternative, it is possible to use such an apparatus that is equipped with the functions of both the apparatus shown in FIG. 18 and the apparatus shown in FIG. 19.

EXAMPLE 1

A light receiving member for use in electrophotography having a light receiving layer disposed on an Al cylinder having a mirror grinded surface was prepared under the layer forming conditions shown in Table 1 using the fabrication apparatus shown in FIG. 18.

And, a sample having only a charge injection inhibition layer on the same kind Al cylinder was prepared in the same manner for forming the charge injection prohibition layer in the above case using the same kind fabrication apparatus as shown in FIG. 18.

For the resulting light receiving member (hereinafter this kind light receiving member is referred to as "drum"), it was set with the conventional electrophotographic copying machine, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined. Thereafter, upper part, middle part and lower part of its image forming part were cut-off, and were engaged in the quantitative anlysis using SIMS to analyze the content of hydrogen atoms in the surface layer for each of the cut-off parts.

As for the resulting sample having only the charge injection prohibition layer, upper part, middle part and lower part respectively in generatrix direction were cut-off, and were subjected to the measurement of diffraction patterns corresponding to Si (111) near 27° of the diffraction angle by the conventional X-ray diffractometer to examine the existence of crystallinity.

The results of the various evaluations, the results of the quantitative anlysis of the content of the hydrogen atoms in the surface layer, and the situations of crystallinity for the sample were as shown in Table 2.

As Table 2 illustrates, significant advantages on the items of initial electrification efficiency, image flow, residual voltage, appearance of a ghost and increase of defective images were acknowledged.

COMPARATIVE EXAMPLE 1

Under the layer forming conditions as shown in Table 3, the drum and the sample were made using the fabrication apparatus of FIG. 19 and in a similar manner as in Example 1, and were provided to examine the same items. The results were as shown in Table 4. As the Table 4 illustrates, much defects on various items were acknowledged compared to the case of Example 1.

EXAMPLE 2

A light receiving member for use in electrophotography having a light receiving layer 100 disposed on an Al cylinder having a mirror grinded surface was prepared under the layer forming conditions shown in Table 5 using the fabrication apparatus shown in FIG. 18.

And a sample having only a charge injection inhibition layer on the same kind Al cylinder as in the above case was prepared in the same manner for forming the charge injection inhibition layer in the above case using the same kind fabrication apparatus as shown in FIG. 18.

For the resulting light receiving member, it was set with the conventional electrophotographic copying machine, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

Thereafter, upper part, middle part and lower part of its image forming part were cut-off, and were engaged in the quantitative analysis using SIMS to analyze the content of hydrogen atoms in the surface layer for each of the cut-off parts. The element profiles of boron atoms (B) and oxygen atoms (O) in the thicknesswise direction of the charge injection inhibition layer for each of the cut-off parts were also examined.

As for the resulting sample having only the charge injection prohibition layer, upper part, middle part and lower part respectively in generatrix direction were cut-off, and were subjected to the measurement of diffraction patterns corresponding to Si (111) near 27° of the diffraction angle by the conventional X-ray diffractometer to examine the existence of crystallinity.

The results of the various evaluations, the results of the quantitative anlysis of the content of the hydrogen atoms in the surface layer, and the situations of crystallinity for the sample were as shown in Table 6.

Figure 22:
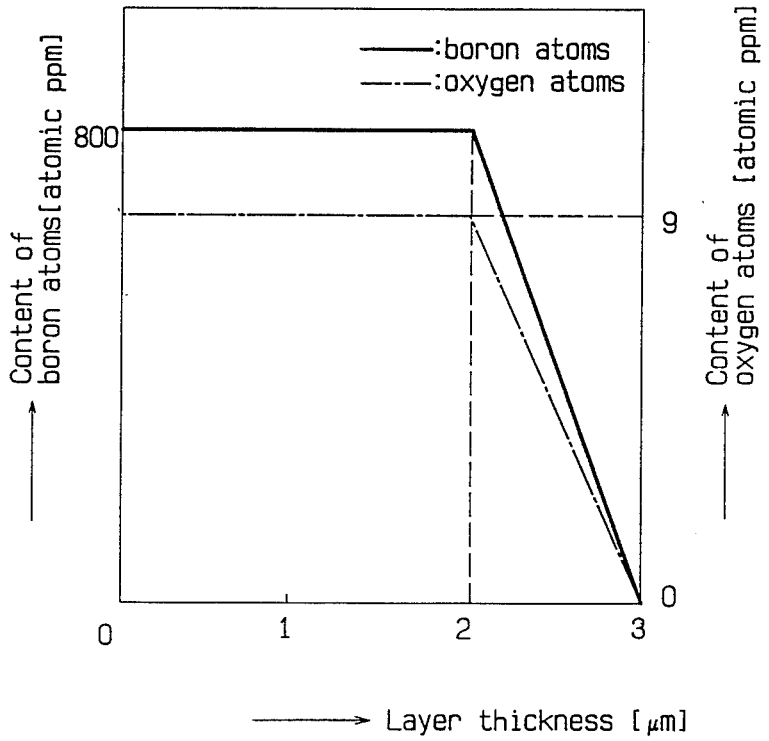
FIG. 22 is a view illustrating the thicknesswise distribution of boron atoms and oxygen atoms in the charge injection inhibition layer in Example 2.

The results of the examination on the element profiles were as shown in FIG. 22.

As table 6 illustrates, significant advantages on the items of initial electrification efficiency, image flow, residual voltage, appearance of a ghost and increase of defective images were acknowledged.

EXAMPLE 3

A light receiving member for use in electrophotography having a light receiving layer disposed on an Al cylinder having a mirror grinded surface was prepared under the layer forming conditions shown in Table 7 using the fabrication apparatuses shown in FIGS. 18 and 19.

Wherein, the charge injection inhibition layer was formed using the fabrication apparatus shown in FIG. 18 and the resultant substrate having the charge injection inhibition layer thereon was transferred through a conventional vacuum transportation device to the fabrication apparatus shown in FIG. 19 in which successive photoconductive layer and surface layer were formed on the previously formed charge injection inhibition layer.

And, a sample having only a charge injection inhibition layer on the same kind Al cylinder was prepared in the same manner for forming the charge injection prohibition layer in the above case using the same kind fabrication apparatus as shown in FIG. 18.

For the resulting light receiving member (hereinafter referred to as "drum"), it was set with the conventional electrophotographic copying machine, and electrophotographic characteristics such as initial electrification efficiency, residual voltage and appearance of a ghost were examined, then decrease in the electrification efficiency, deterioration on photosensitivity and increase of defective images after 1,500 thousand times repeated shots were respectively examined.

Further, the situation of an image flow on the drum under high temperature and high humidity atmosphere at 35° C. and 85% humidity was also examined.

Thereafter, upper part, middle part and lower part of its image forming part were cut-off, and were engaged in the quantitative analysis using SIMS to analyze the content of hydrogen atoms in the surface layer for each of the cutoff parts.

As for the resulting sample having only the charge injection prohibition layer, upper part, middle part and lower part respectively in generatrix direction were cutoff, and were subjected to the measurement of diffraction patterns corresponding to Si (111) near 27° of the diffraction angle by the conventional X-ray diffractometer to examine the existence of crystallinity.

The results of the various evaluations, the results of the quantitative analysis of the content of the hydrogen atoms in the surface layer, and the situations of crystallinity for the sample were as shown in Table 8.

As Table 8 illustrates, significant advantages on the items of initial electrification efficiency, image flow, residual voltage, appearance of a ghost and increase of defective images were acknowledged.

EXAMPLE 4

Multiple drums (Drum Nos. 401 to 406) for analysis under the same conditions as in Example 1, except the conditions for forming a photoconductive layer were changed to those shown in Table 9.

As a result of subjecting these drums to the same evaluations and analysis as in Example 1, the results shown in Table 10 were obtained.

EXAMPLE 5

Multiple drums (Drum Nos. 501 to 506) and samples (Sample Nos. 501-1 to 506-1) having only a charge injection inhibition layer for analysis were provided under the same conditions as in Example 1, except that the conditions for forming a charge injection inhibition layer were changed to those shown in Table 11.

As a result of subjecting these drums and samples to the same evaluations and analysis as in Example 1, the results shown in Table 12 were obtained.

EXAMPLE 6

Multiple drums (Drum Nos. 601 to 606) and samples (Sample Nos. 601-1 to 606-6) having only a charge injection inhibition layer for analysis were provided under the same conditions as in Example 1, except that the conditions for forming a charge injection inhibition layer were changed to those shown in Table 13.

As a result of subjecting these drums and samples to the same evaluations and analysis as in Example 1, the results shown in Table 14 were obtained.

EXAMPLE 7

The same procedures of Example 1 were repeated, except that an IR layer was formed under the conditions shown in Table 15, to thereby provide a drum for analysis.

As a result of subjecting this drum to the same evaluations and analysis as in Example 1, the results shown in Table 16 were obtained.

EXAMPLE 8

Multiple drums (Drum Nos. 801 to 806) having an IR layer were provided under the same conditions as in Example 1 and Example 7, except that the conditions for forming the IR layer were changed to those shown in Table 17.

Figure 23:
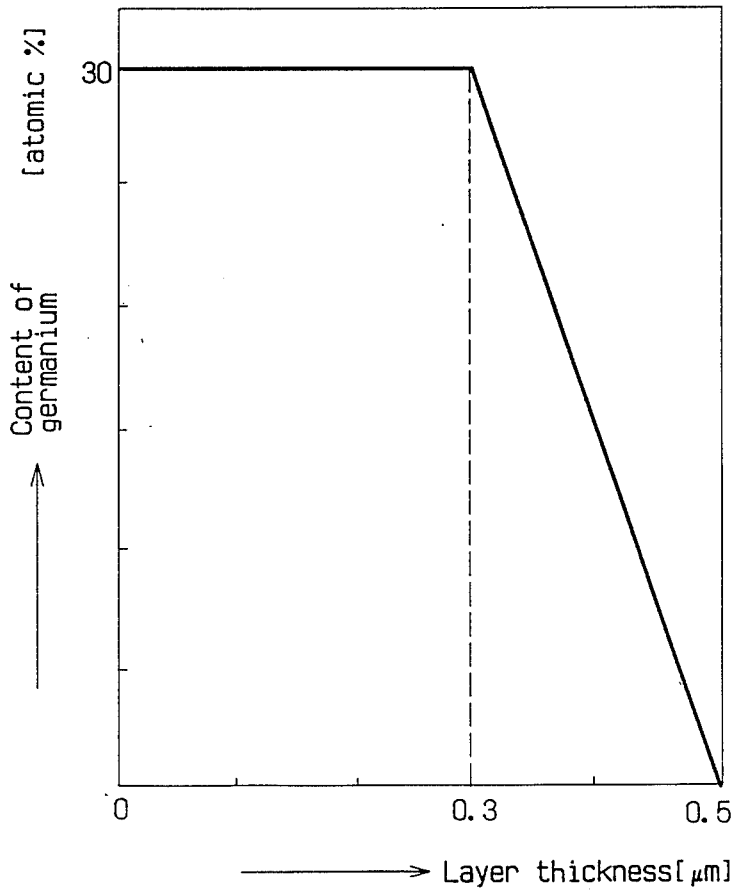
FIG. 23 is a view illustrating the thicknesswise distribution of germanium atoms in the IR layer in Example 8.

As a result of subjecting these drums to the same evaluations and analysis as in Example 1, the results shown in Table 18 were obtained. And, upper part, middle part and lower parts of the image forming part of the drum No. 802 were cut-off, and those cut-off parts were engaged in the quantitative analysis using SIMS to examine the element profile of germanium atoms (Ge) in the thicknesswise direction in the IR layer for each of the cut-off parts. The results were as shown in FIG. 23.

EXAMPLE 9

There were provided multiple drums (Drum Nos. 901 to 903) by firstly forming a contact layer on an Al-cylinder under the conditions in accordance with plasma CVD process shown in Table 19 in the fabrication apparatus shown in FIG. 19, transferring the resultant drum through a vacuum transportation device to the fabrication apparatus shown in FIG. 18 and forming other layers on the previously formed contact layer under the same layer forming conditions as in Example 1.

As a result of subjecting these drums to the same evaluations and analysis as in Example 1, the results shown in Table 20 were obtained.

EXAMPLE 10

Figure 20:
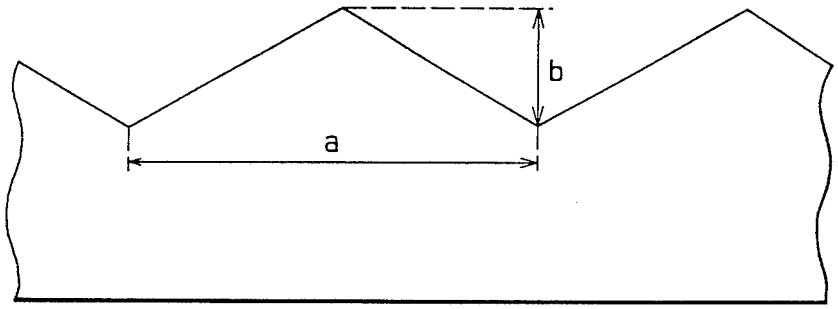
FIG. 20 and FIG. 21 are schematic views respectively illustrating the shape of the surface of the substrate in the light receiving member in Examples 10 and 11.

The mirror grinded cylinders were supplied for grinding process with cutting tool having various degrees With the patterns of FIG. 20 and various cross section patterns as described in Table 21, multiple cylinders were provided. These cylinders were set to the fabrication apparatus of FIG. 18 accordingly, and used to prepare drums (Drum Nos. 1001 to 1005) under the same layer forming conditions of Example 1. The resulting drums were evaluated with the conventional electrophotographic copying machine having digital exposure functions and using semiconductor laser of 780 nm wavelength. The results were as shown in Table 22.

EXAMPLE 11

Figure 21:
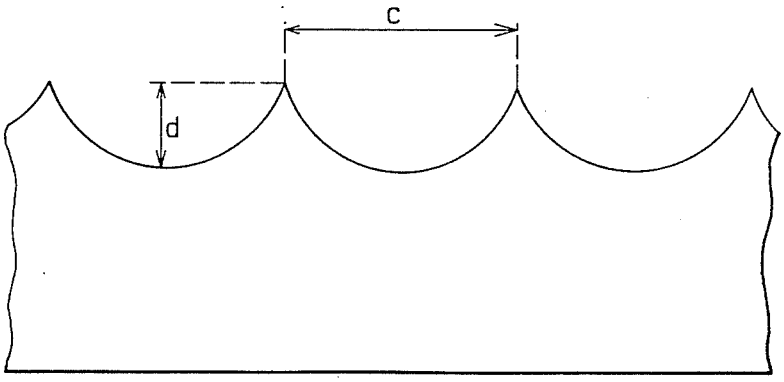

The surface of mirror grinded cylinder was treated by dropping lots of bearing balls thereto to thereby form uneven shape composed of a plurality of fine dimples at the surface, and multiple cylinders having a cross section form of FIG. 21 and of a cross section pattern of Table 23 were provided. These cylinders were set to the fabrication apparatus of FIG. 18 accordingly and used for the preparation of drums (Drum Nos. 1101 to 1105) under the same layer forming conditions of Example 1. The resulting drums are evaluated with the conventional electrophotographic copying machine having digital exposure functions and using semiconductor laser of 780 nm wavelength. The results were as shown in Table 24.

TABLE 1

| Name of layer | Gas used Flow rate (SCCM) | | Substrate temperature (°C.) | Activation condition & Discharging condition | Inner pressure (torr) | Layer thickness (μm) |
|---|---|---|---|---|---|---|
| Charge, | $SiF_4$ | 120 | | * | | |
| injection | $BF_3$ (against $SiF_4$) | 1200 ppm | | | | |
| inhibition | NO | 15 | 450 | microwave plasma 400 w | 0.4 | 1 |
| layer | $H_2$ | 100 | | | | |
| Photo- | $SiF_4$ | 400 | 200 | * | | |
| conductive | $H_2$ | 500 | | microwave plasma 700 w | 0.6 | 20 |
| layer | | | | | | |
| Surface | $SiF_4$ | 20 | | * | | |
| layer | $CF_4$ | 400 | 200 | microwave plasma 300 w | 0.5 | 0.5 |
| | $H_2$ | 200 | | | | |

*Heating at 1150° C. together with Si-solid particles

TABLE 2

| Initial electrification efficiency | Initial sensitivity | Image flow | Residual voltage | Ghost | Defective image | Deterioration of sensitivity | Increase of defective image | Hydrogen content (atomic %) | Crystallinity |
|---|---|---|---|---|---|---|---|---|---|
| ⊙ | ○ | ⊙ | ⊙ | ⊙ | ○ | ○ | ⊙ | 25 | Yes |

⊙ Excellent
○ good
Δ practically applicable
x poor

TABLE 3

| Name of layer | Gas used | Flow rate (SCCM) | Substrate temperature (°C.) | Discharging condition | Inner pressure (torr) | Layer thickness (μm) |
|---|---|---|---|---|---|---|
| Charge, | $SiF_4$ | 200 | | * | | |
| injection | $BF_3$ (against $SiF_4$) | 1200 ppm | | | | |
| inhibition | NO | 15 | 450 | slow discharge plasma 400 w | 0.4 | 1 |
| layer | $H_2$ | 100 | | | | |
| Photo- | $SiF_4$ | 400 | | * | | |
| conductive | $H_2$ | 500 | 200 | slow discharge plasma 700 w | 0.6 | 20 |
| layer | | | | | | |
| Surface | $SiF_4$ | 20 | | * | | |
| layer | $CF_4$ | 400 | 200 | slow discharge plasma 400 w | 0.9 | 0.5 |
| | $H_2$ | 800 | | | | |

TABLE 4

| Initial electrification efficiency | Initial sensitivity | Image flow | Residual voltage | Ghost | Defective image | Deterioration of sensitivity | Increase of defective image | Hydrogen content (atomic %) | Crystallinity |
|---|---|---|---|---|---|---|---|---|---|
| x | ○ | ○ | x | Δ | x | ○ | x | 85 | Yes |

⊙Excellent
○Good
Δ Practically applicable
x Poor

TABLE 5

| Name of layer | Gas used | Flow rate (SCCM) | Substrate temperature (°C.) | Activation condition & Discharging condition | Inner pressure (torr) | Layer thickness (μm) |
|---|---|---|---|---|---|---|
| Charge, | $SiF_4$ | 200 | | * | | |
| injection | $BF_3$ (against $SiF_4$) | 1200 → 0 pmm | | | 0.4 | 1 |
| inhibition | NO | 15 → 0 | 450 | microwave plasma 400 w | | |
| layer | $H_2$ | 100 | | | | |
| Photo- | $SiF_4$ | 400 | | * | | |
| conductive | $H_2$ | 500 | 200 | microwave plasma 700 w | 0.6 | 20 |
| layer | | | | | | |
| Surface | $SiF_4$ | 20 | | * | | |
| layer | $CF_4$ | 350 | 200 | microwave plasma 300 w | 0.5 | 0.5 |
| | $H_2$ | 200 | | | | |

*: Heating at 1150° C. together with Si-solid particles

TABLE 6

| Initial electrification efficiency | Initial sensitivity | Image flow | Residual voltage | Ghost | Defective image | Deterioration of sensitivity | Increase of defective image | Hydrogen content (atomic %) | Crystallinity |
|---|---|---|---|---|---|---|---|---|---|
| ⊙ | ○ | ⊙ | ⊙ | ⊙ | ⊙ | ○ | ⊙ | 20 | Yes |

⊙Excellent
○Good
Δ Practically applicable
x Poor

TABLE 7

| Name of layer | Gas used | Flow rate (SCCM) | Substrate temperature (°C.) | Activation condition & Discharging condition | Inner pressure (torr) | Layer thickness (μm) |
|---|---|---|---|---|---|---|
| Charge, | $SiF_4$ | 200 | | ** | | |
| injection | $BF_3$ (against $SiF_4$) | 1200 pmm | | | 0.4 | 1 |
| inhibition | NO | 15 | 450 | microwave plasma 400 w | | |
| layer | $H_2$ | 100 | | | | |
| * | | | | | 0.4 | 20 |
| Photo- | $SiH_4$ | 350 | 250 | HF wave plasma | | |
| conductive | $H_2$ | 350 | | 300 w | | |
| layer | | | | | | |
| * | $SiH_4$ | 10 | 250 | HF wave Plasma | 0.45 | 0.5 |
| Surface | $CH_4$ | 500 | | 200 w | | |
| layer | | | | | | |

*: Prepared by plasma CVD process
**: Heating at 1150° C. together with Si-solid particles

TABLE 8

| Initial electrifi cation efficiency | Initial sensi-tivity | Image flow | Residual votage | Ghost | Defective image | Deterio-ration of sensitivity | Increase of defective image | Hydrogen Content (atomic %) | Crystallinity |
|---|---|---|---|---|---|---|---|---|---|
| ⊙ | ○ | ⊙ | ⊙ | ⊙ | ○ | ○ | ⊙ | 30 | Yes |

⊙Excellent
○Good
Δ Practically Applicable
x Poor

TABLE 9

| Drum No. | 401 | 402 | 403 | 404 | 405 | 406 |
|---|---|---|---|---|---|---|
| Flow rate (sccm) | $SiF_4$ 400<br>$H_2$ 350 | $SiF_4$ 300<br>$H_2$ 700 | $SiF_4$ 400<br>$H_2$ 500<br>$BF_3$ 0.3 ppm (against $SiF_4$) | $SiF_4$ 400<br>$H_2$ 500 | $SiF_4$ 400<br>$H_2$ 350<br>$BF_3$ 0.3 ppm (against $SiF_4$) | $SiF_4$ 400<br>$H_2$ 300 |
| Substrate temperature (°C.) | 200 | 200 | 200 | 200 | 200 | 200 |
| Activation condition for $SiF_4$ | Heating at 1150° C. together with Si-solid particles | ← | ← | Microwave plasma 300 W | ← | Heating at 1150° C. together with Si-solid particles |
| Activation condition for $H_2$ etc. | Microwave plasma 500 W | Microwave plasma 800 W | Microwe plasma 700 W | ← | ← | W-filament 2500° C. |
| Inner pressure (torr) | 0.4 | 0.45 | 0.6 | 0.6 | 0.5 | 0.4 |
| Layer thickness (μm) | 20 | 20 | 20 | 20 | 20 | 20 |

TABLE 10

| Drum No. | Inital electrifi-cation efficiency | Initial sensi-tivity | Image flow | Residual voltage | Ghost | Defective image | Deterio-ration of sensitivity | Increase of defective image |
|---|---|---|---|---|---|---|---|---|
| 401 | ○ | ⊙ | ⊙ | ⊙ | ⊙ | ⊙ | ○ | ⊙ |
| 402 | ⊙ | ○ | ⊙ | ⊙ | ⊙ | ○ | ○ | ○ |
| 403 | ○ | ○ | ⊙ | ⊙ | ⊙ | ⊙ | ○ | ⊙ |
| 404 | ⊙ | ○ | ⊙ | ⊙ | ⊙ | ○ | ○ | ○ |
| 405 | ⊙ | ○ | ⊙ | ⊙ | ⊙ | ○ | ○ | ○ |
| 406 | ○ | ○ | ⊙ | ⊙ | ⊙ | ⊙ | ○ | ⊙ |

⊙Excellent
○Good
Δ Practically applicable
x Poor

TABLE 11

| Drum No. | 501 | 502 | 503 | 504 | 505* | 506 |
|---|---|---|---|---|---|---|
| Flow rate (sccm) | $SiF_4$ 200<br>$BF_3$ 500 ppm (against $SiF_4$)<br>NO 10<br>$H_2$ 100 | $SiF_4$ 200<br>$BF_3$ 100 ppm (against $SiF_4$)<br>NO 5<br>$H_2$ 100 | $SiF_4$ 200<br>$PF_5$ 100 ppm (against $SiF_4$)<br>NO 5<br>$H_2$ 100 | $SiF_4$ 200<br>$BF_3$ 500 ppm (against $SiF_4$)<br>NO 10<br>$H_2$ 200 | $SiF_4$ 200<br>$BF_3$ 1200 ppm (against $SiF_4$)<br>NO 10<br>$H_2$ 200 | $SiF_4$ 100<br>$BF_3$ 500 ppm (against $SiF_4$)<br>NO 10<br>$H_2$ 100 |
| Substrate temperature (°C.) | 450 | 450 | 450 | 450 | 450 | 550 |
| Activation condition for $H_2$ etc. | Microwave plasma 400 W | ← | ← | Microwave plasma 550 W | ← | W-filament 2500° C. |
| Inner pressure (torr) | 0.4 | 0.4 | 0.4 | 0.45 | 0.45 | 0.35 |
| Layer thickness (μm) | 1 | 1 | 1 | 1 | 1 | 0.8 |

Note: The activation condition for $SiF_4$: Heating at 1150° C. together with Si-solid particles.
*: The layer forming conditions for photoconductive layer and surface layer are the same as in Example 3.

TABLE 12

| Drum No. | Initial electrifi-cation efficiency | Initial sensi-tivity | Image flow | Residual voltage | Ghost | Defective image | Deterio-ration of sensitivity | Increase of defective image | Remarks |
|---|---|---|---|---|---|---|---|---|---|
| 501 | ⊙ | ○ | ⊙ | ⊙ | ⊙ | ⊙ | ○ | ○ | |
| 502 | ○ | ⊙ | ⊙ | ⊙ | ⊙ | ○ | ○ | ○ | |

TABLE 12-continued

| | | | | | | | | | |
|---|---|---|---|---|---|---|---|---|---|
| 503 | ○ | ○ | ○ | ○ | ⊙ | ○ | ○ | ○ | (−) electrification |
| 504 | ⊙ | ⊙ | ○ | ⊙ | ○ | ⊙ | ○ | ⊙ | |
| 505 | ○ | ○ | ⊙ | ⊙ | ⊙ | ○ | ○ | ⊙ | |
| 506 | ⊙ | ○ | ⊙ | ⊙ | ⊙ | ○ | ○ | ⊙ | |

| Sample No. | Crystallinity |
|---|---|
| 501-1 | Yes |
| 502-1 | Yes |
| 503-1 | Yes |
| 504-1 | Yes |
| 505-1 | Yes |
| 506-1 | Yes |

⊙Excellent
○Good
Δ Practically applicable
x Poor

TABLE 13

| Drum No. | 601 | 602 | 603 | 604 | 605* | 606 |
|---|---|---|---|---|---|---|
| Flow rate (sccm) | $SiF_4$ 200<br>$BF_3$ 500 ppm → 0 (against $SiF_4$)<br>NO 10 → 0<br>$H_2$ 100 | $SiF_4$ 200<br>$BF_3$ 100 ppm → 0 (against $SiF_4$)<br>NO 5 → 0<br>$H_2$ 100 | $SiF_4$ 200<br>$PF_5$ 100 ppm → 0 (against $SiF_4$)<br>NO 5 → 0<br>$H_2$ 100 | $SiF_4$ 200<br>$BF_3$ 500 ppm → 0 (against $SiF_4$)<br>NO 10 → 0<br>$H_2$ 200 | $SiF_4$ 200<br>$BF_3$ 1000 ppm → 0 (against $SiF_4$)<br>NO 10 → 0<br>$H_2$ 200 | $SiF_4$<br>$BF_3$ 500 ppm → 0 (against $SiF_4$)<br>NO 10 → 0<br>$H_2$ 100 |
| Substrate temperature (°C.) | 450 | 450 | 450 | 450 | 450 | 550 |
| Activation condition for $H_2$ etc. | Microwave plasma 400 W | ← | ← | Microwave plasma 550 W | ← | W-filament 2500° C. |
| Inner pressure (torr) | 0.4 | 0.4 | 0.4 | 0.45 | 0.45 | 0.35 |
| Layer thickness (μm) | 1 | 1 | 1 | 1 | 1 | 0.8 |

Note:
The activation condition for $SiF_4$:Heating at 1150° C. together with Si-solid particles.
The layer forming conditions for photoconductive layer and surface layer are the same as in Example 3.

TABLE 14

| Drum No. | Initial electrification efficiency | Initial sensitivity | Image flow | Residual voltage | Ghost | Defective image | Deterioration of sensitivity | Increase of defective image |
|---|---|---|---|---|---|---|---|---|
| 601 | ⊙ | ○ | ⊙ | ⊙ | ⊙ | ⊙ | ○ | ⊙ |
| 602 | ⊙ | ○ | ⊙ | ○ | ⊙ | ○ | ○ | ○ |
| 603 | ○ | ○ | ○ | ○ | ⊙ | ○ | ○ | ○ |
| 604 | ⊙ | ○ | ○ | ⊙ | ○ | ○ | ○ | ⊙ |
| 605 | ○ | ○ | ⊙ | ⊙ | ⊙ | ⊙ | ○ | ⊙ |
| 606 | ⊙ | ○ | ⊙ | ⊙ | ⊙ | ○ | ○ | ○ |

| Sample No. | Crystallinity |
|---|---|
| 601-1 | Yes |
| 602-1 | Yes |
| 603-1 | Yes |
| 604-1 | Yes |
| 605-1 | Yes |
| 606-1 | Yes |

⊙Excellent
Good
Δ Practically applicable
x Poor

TABLE 15

| Name of layer | Gas used Flow rate (SCCM) | | Substrate temperature (°C.) | Activation condition & Discharging condition | Inner pressure (torr) | Layer thickness (μm) |
|---|---|---|---|---|---|---|
| IR layer | $SiF_4$ | 200 | 450 | * | 0.4 | 0.5 |
| | $GeF_4$ | 30 | | microwave plasma 150 w | | |
| | $BF_3$ (against $SiF_4$) | 1200 ppm | | | | |
| | NO | 15 | | | | |

TABLE 15-continued

| Name of layer | Gas used Flow rate (SCCM) | Substrate temperature (°C.) | Activation condition & Discharging condition | Inner pressure (torr) | Layer thickness (μm) |
|---|---|---|---|---|---|
| $H_2$ | 100 | microwave plasma 400 w | | | |

*Heating at 1150° C. together with Si-solid particles

TABLE 16

| Initial electrification efficiency | Initial sensitivity | Image flow | Interference fringe | Residual voltage | Ghost | Defective image | Deterioration of sensitivity | Increase of defective image |
|---|---|---|---|---|---|---|---|---|
| ⊙ | ○ | ⊙ | ○ | ⊙ | ○ | ○ | ○ | ⊙ |

⊙ Excellent
○ Good
Δ Practically applicable
x Poor

TABLE 17

| Drum No. | 801 | 802 | 803 | 804 | 805 | 806 |
|---|---|---|---|---|---|---|
| Flow rate (sccm) | $SiF_4$ 200<br>$BF_3$ 1200 ppm<br>(against $SiF_4$)<br>NO 10<br>$GeH_4$ 30→0<br>$H_2$ 100 | $SiF_4$ 200<br>$BF_3$ 100 ppm→0<br>(aganist $SiF_4$)<br>NO 5→0<br>$GeH_4$ 50→0<br>$H_2$ 100 | $SiF_4$ 200<br>$PF_5$ 100 ppm<br>(against $SiF_4$)<br>NO 5<br>$GeH_4$ 70→0<br>$H_2$ 100 | $SiF_4$ 200<br>$BF_3$ 1200 ppm<br>(against $SiF_4$)<br>NO 10<br>$GeH_4$ 30→0<br>$H_2$ 100 | $SiF_4$ 200<br>$BF_3$ 1200 ppm→0<br>(against $SiF_4$)<br>NO 10<br>$GeH_4$ 50→0<br>$H_2$ 200 | $SiF_4$ 100<br>$BF_3$ 500 ppm<br>(against $SiF_4$)<br>NO 10<br>$GeH_4$ 20→0<br>$H_2$ 100 |
| Substrate temperature (°C.) | 450 | 450 | 450 | 250 | 450 | 450 |
| Inner pressure (torr) | 0.4 | 0.4 | 0.4 | 0.4 | 0.4 | 0.35 |
| Layer thickness (μm) | 0.5 | 0.5 | 0.5 | 0.5 | 0.5 | 0.4 |
| | | | | * | | * |

*The layer forming conditions for photoconductive layer and surface layer are the same as in Example 3.

TABLE 18

| Drum No. | Initial electrification efficiency | Initial sensitivity | Image flow | Interference fringe | Residual voltage | Ghost | Defective image | Deterioration of sensitivity | Increase of defective image |
|---|---|---|---|---|---|---|---|---|---|
| 801 | ○ | ○ | ○ | ⊙ | ⊙ | ⊙ | | | |
| 802 | ⊙ | ○ | ○ | ⊙ | ⊙ | ⊙ | | | |
| 803 | ⊙ | ○ | ⊙ | ⊙ | ○ | ⊙ | | | |
| 804 | ○ | ○ | ○ | ○ | ○ | ○ | | | |
| 805 | ○ | ○ | ⊙ | ⊙ | ⊙ | ⊙ | | | |
| 80 | ○ | ○ | ○ | ○ | ⊙ | ○ | | | |

Excellent
Good
Δ Practically applicable
x . . . Poor

TABLE 19

| Drum No. | 901 | 902 | 903 |
|---|---|---|---|
| Flow rate (SCCM) | $SiH_4$ 60<br>$NH_3$ 550 | $SiH_4$ 60<br>NO 400 | $SiH_4$ 60<br>$N_2$ 700 |
| Substrate temperature (°C.) | 300 | 300 | 300 |
| RF power (W) | 150 | 200 | 200 |

TABLE 19-continued

| Drum No. | 901 | 902 | 903 |
|---|---|---|---|
| Internal pressure (torr) | 0.35 | 0.3 | 0.4 |
| Layer thickness (μm) | 0.1 | 0.1 | 0.1 |

TABLE 20

| Drum No. | Initial electrification efficiency | Initial sensitivity | Image flow | Residual voltage | Ghost | Defective image | Deterioration of sensitivity | Increase of defective image |
|---|---|---|---|---|---|---|---|---|
| 901 | ⊙ | ○ | ⊙ | ⊙ | ⊙ | ○ | ⊙ | ○ |
| 902 | ○ | ○ | ○ | ⊙ | ⊙ | ○ | ⊙ | ○ |

TABLE 20-continued

| Drum No. | Initial electrification efficiency | Initial sensitivity | Image flow | Residual voltage | Ghost | Defective image | Deterioration of sensitivity | Increase of defective image |
|---|---|---|---|---|---|---|---|---|
| 903 | ⊙ | ○ | ⊙ | ⊙ | ⊙ | ⊙ | ○ | ⊙ |

Excellent
Good
Δ Practically applicable
x Poor

TABLE 21

| Drum No. | 1001 | 1002 | 1003 | 1004 | 1005 |
|---|---|---|---|---|---|
| a [μm] | 25 | 50 | 50 | 12 | 12 |
| b [μm] | 0.8 | 2.5 | 0.8 | 1.5 | 0.3 |

TABLE 22

| Sample No. | Initial electrification efficiency | initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 1001 | ⊙ | ○ | ⊙ | ○ | ⊙ | ⊙ | ⊙ | ○ | ⊙ | ⊙ |
| 1002 | ○ | ⊙ | ⊙ | Δ | ⊙ | ⊙ | ○ | ○ | ⊙ | ○ |
| 1003 | ○ | ○ | ⊙ | Δ | ⊙ | ⊙ | ○ | ○ | ⊙ | ○ |
| 1004 | ⊙ | ⊙ | ⊙ | ○ | ⊙ | ⊙ | ○ | ○ | ⊙ | ⊙ |
| 1005 | ⊙ | ○ | ⊙ | Δ | ⊙ | ⊙ | ⊙ | ○ | ⊙ | ⊙ |

Excellent
Good
Δ Practically applicable
x Poor

TABLE 23

| Drum No. | 1101 | 1102 | 1103 | 1104 | 1105 |
|---|---|---|---|---|---|
| c [μm] | 50 | 100 | 100 | 30 | 30 |
| d [μm] | 2 | 5 | 1.0 | 2.5 | 0.7 |

TABLE 24

| Sample No. | Initial electrification efficiency | Initial sensitivity | Image flow | Interference fringe | Residual voltage | Ghost | Defective image | Deterioration of sensitivity | Increase of defective image | Image resolving power |
|---|---|---|---|---|---|---|---|---|---|---|
| 1101 | ○ | ○ | ⊙ | Δ-○ | ⊙ | ⊙ | ○ | ○ | ⊙ | ○ |
| 1102 | ⊙ | ⊙ | ⊙ | ○ | ⊙ | ⊙ | ○ | ○ | ⊙ | ○ |
| 1103 | ○ | ○ | ⊙ | Δ | ⊙ | ⊙ | ⊙ | ○ | ⊙ | ○ |
| 1104 | ⊙ | ⊙ | ⊙ | ○ | ⊙ | ⊙ | ○ | ○ | ⊙ | ⊙ |
| 1105 | ⊙ | ○ | ⊙ | Δ-○ | ⊙ | ⊙ | ⊙ | ○ | ⊙ | Δ-○ |

Excellent
Good
x Practically applicable
Δ Poor

What we claim is:

1. A light receiving member for use in electrophotography comprising: a substrate for electrophotography and a light receiving layer disposed on said substrate, said light receiving layer comprising a charge injection inhibition layer of 0.01 to 10 pm in thickness, a photoconductive layer of 1 to 100 μm in thickness; and a surface layer of 0.003 to 30 μm in thickness being disposed in this order from the side of said substrate; said charge injection inhibition layer comprising a polycrystalline material containing silicon atoms as the main constituent and 30 $5\times10^4$ atomic ppm of a conductivity controlling element selected from the group consisting of Group III and Group V elements of the Periodic Table; said charge injection inhibition layer being formed by chemically reacting (i) a precursor (A) generated from a silicon- and halogen-containing substance (a) by subjecting said compound (a) to the action of an activation energy; (ii) an active species (B) generated from a substance (b) selected from the group consisting of $H_2$, HF, HCl, HBr and HI by subjecting said substance (b) to the action of an activation energy, and (iii) a gaseous substance (c) for imparting said conductivity controlling element in the absence of a plasma in a film deposition space while adjusting the volume ratio of said precursor (A) to said active species (B) to be in the range from 20:1 to 1:20 based on flow ratio; said photoconductive layer comprising an amorphous material containing silicon atoms as the main constituent and at least one kind of atom selected from hydrogen atoms and halogen atoms in a total amount of 1 to 40 atomic % and said surface layer having a free surface and comprising an amorphous material of the formula: $x)_y:H_{1-y}$, wherein x is 0.1 to 0.99999 and y is 0.6 to 0.999.

2. A light receiving member for use in electrophotography according to claim 1, wherein the substrate is electrically insulative.

3. A light receiving member for use in electrophotography according to claim 1, wherein the substrate is electroconductive.

4. A light receiving member for use in electrophotography according to claim 1, wherein the substrate is an aluminum alloy.

5. A light receiving member for use in electrophotography according to claim 1, wherein the substrate is cylindrical in form.

6. A light receiving member for use in electrophotography according to claim 1, wherein the substrate has an uneven surface.

7. A light receiving member for use in electrophotography according to claim 1, wherein the substrate has an irregular surface.

8. A light receiving member for use in electrophotography according to claim 1, wherein said conductivity controlling element of Group III is a member selected from the group consisting of B, Al, Ga, In and Tl.

9. A light receiving member for use in electrophotography according to claim 1, wherein said conductivity controlling element of Group V is a member selected from the group consisting of P, As, Sb and Bi.

10. A light receiving member for use in electrophotography according to claim 1, wherein said substance (a) is at least one member selected from the group consisting of $SiF_4$, $(SiF_2)_5$, $(SiF_2)_6$, $(SiF_2)_4$, $Si_2F_6$, $Si_3F_8$, $Si_4F_{10}$, $SiHF_3$, $SiH_2F_2$, $SiH_3F$, $SiCl_4$, $(SiCl_2)_5$, $SiBr_4$, $(SiBr_2)_5$, $Si_2Cl_6$, $Si_3Cl_8$, $Si_2Br_6$, $Si_3Br_8$, $SiHCl_3$, $SiH_2Cl_2$, $SiHBr_3$, $SiH_2Br_2$, $SiHI_3$, $SiH_2I_2$, $Si_2H_3F_3$ and $Si_2Cl_3F_3$.

11. A light receiving member for use in electrophotography according to claim 1, wherein said gaseous substance (c) is a compound containing the conductivity controlling element.

12. A light receiving member for use in electrophotography according to claim 10, wherein said compound is activated by subjecting said compound to activation energy.

13. A light receiving member for use in electrophotography according to claim 11, wherein said compound is a member selected from the group consisting of $PH_3$, $P_2H_4$, $PF_3$, ;$PF_5$, $PCl_3$, $AsH_3$, $AsF_5$, $AsCl_3$, $SbH_3$, $SbF_5$, $BF_3$, $BCl_3$, $BBr_3$, $B_2H_6$, $B_4H_{10}$, $B_5H_9$, $B_5H_{11}$, $B_6H_{10}$, $B_6H_{12}$ and $AlCl_3$.

14. A light receiving member for use in electrophotography according to claim 1, wherein said polycrystalline material constituting the charge injection inhibition layer further contains at least one kind of atom selected from the group consisting of hydrogen atoms and halogen atoms in a total amount of 1 to 40 atomic %.

15. A light receiving member for use in electrophotography according to claim 1, wherein said polycrystalline material constituting the charge injection inhibition layer further includes from 0.001 to 50 atomic % of at least one kind of atom selected from the group consisting of nitrogen atoms, oxygen atoms and carbon atoms formed by exciting a precursor (D) capable of imparting the atoms (N,O,C) in the chemical reaction of the precursor (A) with the active species (B); said precursor (D) being a precursor generated from a substance (d) containing the atoms (N,O,C) by subjecting said substance (d) to the action of an activation energy.

16. A light receiving member for use in electrophotography according to claim 15, wherein said substance (d) is a member selected from the group consisting of nitrogen-source-containing compound, oxygen-source-containing compound and carbon-source-containing compound.

17. A light receiving member for use in electrophotography according to claim 1, wherein the photoconductive layer has p-type semiconductor characteristics.

18. A light receiving member for use in electrophotography according to claim 1, wherein the photoconductive layer has n-type semiconductor characteristics.

19. A light receiving member for use in electrophotography according to claim 1, wherein the photoconductive layer has i-type semiconductor characteristics.

20. A light receiving member for use in electrophotography according to claim 1, wherein the photoconductive layer contains an element of Group III of the Periodic Table.

21. A light receiving member for use in electrophotography according to claim 20, wherein said element is selected from the group consisting of B, Al, Ga, In and Tl.

22. A light receiving member for use in electrophotography according to claim 20, wherein the amount of said element contained in the photoconductive layer is from 0.001 to 300 atomic ppm.

23. A light receiving member for use in electrophotography according to claim 1, wherein the photoconductive layer contains an element of Group V of the Periodic Table.

24. A light receiving member for use in electrophotography according to claim 23, wherein said element is selected from the group consisting of F, As, Sb and Bi.

25. A light receiving member for use in electrophotography according to claim 23, wherein the amount of said element contained in the photoconductive layer is from 0.001 to 300 atomic ppm.

26. A light receiving member for use in electrophotography according to claim 1, wherein the photoconductive layer contains at least one kind of atom selected from the group consisting of nitrogen atoms and oxygen atoms.

27. A light receiving member for use in electrophotography according to claim 26, wherein the amount of the nitrogen atoms contained in the photoconductive layer is from $5\times10^{-4}$ to 30 atomic %.

28. A light receiving member for use in electrophotography according to claim 26, wherein the amount of the oxygen atoms contained in the photoconductive layer is from $5\times10^{-4}$ to 30 atomic %.

29. A light receiving member for use in electrophotography according to claim 26, wherein the sum of the nitrogen atoms and of the oxygen atoms in the photoconductive layer is from $5\times10^{-4}$ to 30 atomic %.

30. A light receiving member for use in electrophotography according to claim 1, wherein said light receiving layer includes a 30 Å to 50 μm thick long wavelength light absorption layer disposed between the substrate and the charge injection inhibition layer; said long wavelength absorption layer comprising a material selected from an amorphous material containing silicon atoms, 1 to $1\times10^6$ atomic ppm of germanium atoms, at least one kind of atom selected from hydrogen atoms and halogen atoms and 0.001 to $5\times10^5$ atomic ppm of a conductivity controlling element selected from the group consisting of Group III and Group V containing silicon atoms, 1 to $1\times10^6$ atomic ppm of germanium atoms, at least one kind of atom selected from hydrogen atoms and halogen atoms and 0.001 to $5\times10^5$ atomic ppm of a conductivity controlling element selected from the group consisting of Group III and Group V elements of the Periodic Table.

31. A light receiving member for use in electrophotography according to claim 30, wherein said amorphous material further contains 0.01 to 40 atomic % of at least one kind of atom selected from the group consisting of nitrogen atoms, oxygen atoms and carbon atoms.

32. A light receiving member for use in electrophotography according to claim 30, wherein said polycrystalline material further contains 0.01 to 40 atomic % of at least one kind of atom selected from the group consisting of nitrogen atoms, oxygen atoms and carbon atoms.

33. A light receiving member for use in electrophotography according to claim 30, wherein the light receiving layer further contains a 0.01 to 10 μm thick contact layer between the substrate and the long wavelength light absorption layer; said contact layer comprising an amorphous material containing silicon atoms, 0.1 to 70 atomic % of at least one kind of atom selected from the group consisting of hydrogen atoms and halogen atoms, and $5\times10^{-4}$ to 70 atomic % of at least one kind of atom selected from the group consisting of nitrogen atoms, oxygen atoms and carbon atoms.

34. Alight receiving member for use in electrophotography according to claim 33, wherein said amorphous material further contains a conductivity controlling element.

35. A electrophotographic process comprising:

(a) applying an electric field to the light receiving member of claim 1; and (b) applying an electromagnetic wave to said light receiving member thereby forming an electrostatic image.

* * * * *

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

Title page,

IN [57] ABSTRACT

Line 2, "on" should read --an--.

COLUMN 1

Line 1, "STET" should read --continuation-in-part--.

COLUMN 3

Line 17, "forcusing" should read --focusing--.
Line 63, "is" should read --is to--.

COLUMN 4

Line 53, "along" should read --a long--.
Line 54, "registant" should read --resistance--.

COLUMN 5

Line 41, CLose up left margin.

COLUMN 7

Line 7, "substrate" should read --substrate.--.

COLUMN 8

Line 56, "fur" should read --for--.

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 10

Line 56, "practices" should read --practiced--.

COLUMN 12

Line 68, "HCl gas" (second occurrence) should be deleted.

COLUMN 13

Line 2, "usable" should read --usable.--.
Line 57, "sa" should read --as--.
Line 64, "kind atom" should read --kind of atom--.

COLUMN 14

Line 24, "kind atoms" should read --kind of atoms--.
Line 29, "kind atoms" should read --kind of atoms--.
Line 35, "amines. As" should read --amines. ¶ As--.
Line 52, "$_{SiNH2}$" should read --$SiNH_2$--.
Line 61, "kind atoms" should read --kind of atoms--.
Line 65, "a" should read --an--.
Line 66, "kind atoms" should read --kind of atoms--.

COLUMN 15

Line 28, "kind atom" should read --kind of atom--.

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 16

Line 1, "and concentration" should read --and concentration--.
Line 2, "c6" should read --$C_6$--.
Line 29, "104" should read --$10^4$--.
Line 30, "104" should read --$10^4$--.

COLUMN 18

Line 59, "halogen atoms (H)" should read --halogen atoms (X)--.
Line 66, "and" (second occurrence) should read --are--.

COLUMN 19

Line 46, "in photoconductiveness" should read --nonphotoconductivity--.
Line 50, "under," should read --under--.
Line 60, "repreating" should read --repeating--.

COLUMN 20

Line 42, "kind atoms" should read --kind of atoms--.

COLUMN 21

Line 36, "becomes" should read --comes--.

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 22

Line 9, "atoms %" should read --atomic %--.
Line 50, "$10^1$" should read --$10^{-1}$--.

COLUMN 23

Line 1, "determined." should read --determined--.

COLUMN 24

Line 3, "JR layer" should read --IR layer--.
Line 16, "orgasifiable" should read --or gasifiable--.

COLUMN 25

Line 51, "siliconcontaining" should read --silicon-containing--.

COLUMN 27

Line 5, "($H_2NNH_2$)." should read --($H_2NNH_2$),--.
Line 60, "upon forming that" should be deleted.

COLUMN 31

Line 20, "in" should read --instead--.
Line 21, "stead" should be deleted.
Line 27, "a" should read --an--.
Line 58, "thereinto." should read --thereinto--.

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 32

Line 46, ""$B_2H_{6/H2}$")" should read --"$B_2H_6/H_2$")--.
Line 64, "$_{gas}$" should read --gas--.

COLUMN 33

Line 31, "in stead" should read --instead--.
Line 33, "rised." should read --raised.--.

COLUMN 34

Line 7, "bing" should read --being--.

COLUMN 35

Line 57, "table 6" should read --Table 6--.

COLUMN 38

Lines 14-15, "degrees" should read --degrees.--.

COLUMN 40

TABLE 3, "slow" (all occurrences) should read --glow--.

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 42

TABLE 10, "Increase of defective image ⊙ ○ ⊙ ○ ○ ⊙ " should read --Increase of defective image ○ ⊙ ○ ⊙ ○ ⊙ --.

COLUMN 43

TABLE 13, "The layer" should read --*): The layer--.

TABLE 14, " ⊙ Excellent Good " should read -- ⊙ Excellent ○ Good --.

COLUMN 45

TABLE 18, "80" should read --806-- and

" Excellent Good " should read -- ⊙ Excellent ○ Good --.

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 45

TABLE 18,

"

| Residual voltage | Ghost | Defective image | Deterio-ration of sensitivity | Increase of defective image |
|---|---|---|---|---|
| ⊙ | ⊙ | | | |
| ⊙ | ⊙ | | | |
| ○ | ⊙ | | | |
| ⊙ | ○ | | | |
| ⊙ | ⊙ | | | |
| | ○ | | | |

should read

--

| Residual voltage | Ghost | Defective image | Deterio-ration of sensitivity | Increase of defective image |
|---|---|---|---|---|
| ⊙ | ⊙ | ○ | ○ | ○ |
| ⊙ | ○ | ⊙ | ○ | ⊙ |
| ⊙ | ⊙ | ○ | ○ | ○ |
| ⊙ | ⊙ | ○ | ○ | ○ |
| ⊙ | ⊙ | ⊙ | ○ | ○ |
| ⊙ | ⊙ | ○ | ○ | ○ |

--

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 46

TABLE 20, "

| Defective image | Deterio-ration of sensitivity | Increase of defective image |
|---|---|---|
| ○ | ⊙ | ○ |
| ○ | ⊙ | ○ |

"

should read --

| Defective image | Deterio-ration of sensitivity | Increase of defective image |
|---|---|---|
| ⊙ | ○ | ⊙ |
| ⊙ | ○ | ⊙ |

--.

COLUMN 47

TABLE 20-continued,

" Excellent should -- ⊙Excellent
Good " read ○Good --.

TABLE 22, " Excellent should -- ⊙Excellent
Good " read ○Good --.

TABLE 24, " Excellent should -- ⊙Excellent
Good " read ○Good --.

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 47

Line 61, "30 5 X $10^4$ atomic ppm" should read --30 to 5 X $10^4$ atomic ppm--.

COLUMN 48

Line 55, "$x)_y:H_{1-y}$," should read --$A-(Si_xC_{1-x})_y:H_{1-y}$,--.

COLUMN 49

Line 18, "$_{(SiF2)5}$," should read --$(SiF_2)_5$,-- and "$(SiF_2)6$," should read --$(SiF_2)_6$,--.

COLUMN 50

Line 56, "Group V" should read --Group V elements of the Periodic Table and a polycrystalline material--.

UNITED STATES PATENT AND TRADEMARK OFFICE

CERTIFICATE OF CORRECTION

PATENT NO. : 4,940,642

DATED : July 10, 1990

INVENTOR(S) : SHIGERU SHIRAI, ET AL.

It is certified that error appears in the above-identified patent and that said Letters Patent is hereby corrected as shown below:

COLUMN 52

Line 4, "Alight" should read --A light--.
Line 8, "A" should read --An--.

Signed and Sealed this

Thirtieth Day of July, 1991

*Attest:*

*Attesting Officer*

HARRY F. MANBECK, JR.

*Commissioner of Patents and Trademarks*